US005844484A

United States Patent [19]

Fujiuchi et al.

[11] Patent Number: 5,844,484

[45] Date of Patent: Dec. 1, 1998

[54] THEFT PREVENTIVE APPARATUS HAVING ALARM OUTPUT

[75] Inventors: Hiroyuki Fujiuchi; Masaaki Takeshita; Keinji Uchida, all of Osaka; Tsutomu Ida, Tomioka; Mitsuhiko Nakajima, Kamiina-gun, all of Japan

[73] Assignee: Kubota Corporation, Osaka, Japan

[21] Appl. No.: 432,141

[22] PCT Filed: Aug. 25, 1994

[86] PCT No.: PCT/JP94/01407

§ 371 Date: Apr. 28, 1995

§ 102(e) Date: Apr. 28, 1995

[87] PCT Pub. No.: WO95/06924

PCT Pub. Date: Mar. 9, 1995

[30] Foreign Application Priority Data

| | | | |
|---|---|---|---|
| Aug. 31, 1993 | [JP] | Japan | 5-215881 |
| Aug. 31, 1993 | [JP] | Japan | 5-215882 |
| Aug. 31, 1993 | [JP] | Japan | 5-215884 |

[51] Int. Cl.[6] ..... G08B 13/187

[52] U.S. Cl. ..... 340/572; 340/568; 340/691; 340/693

[58] Field of Search ..... 340/568, 693, 340/691, 572

[56] References Cited

U.S. PATENT DOCUMENTS

| | | | |
|---|---|---|---|
| 3,253,271 | 5/1966 | Trupiano et al. . | |
| 3,755,803 | 8/1973 | Cole et al. | 340/572 |
| 3,995,900 | 12/1976 | Humble et al. . | |
| 4,000,543 | 1/1977 | Paskert | 340/572 |
| 4,274,088 | 6/1981 | Pierson et al. . | |
| 4,987,754 | 1/1991 | Minasy | 70/57.1 |
| 4,992,776 | 2/1991 | Crossfield | 340/572 |
| 5,191,314 | 3/1993 | Ackerman et al. | 340/693 |
| 5,610,587 | 3/1997 | Fujiuchi et al. . | |
| 5,656,998 | 8/1997 | Fujiuchi et al. . | |

FOREIGN PATENT DOCUMENTS

| | | |
|---|---|---|
| 0 385 800 | 9/1990 | European Pat. Off. . |
| 52-82094 | 7/1977 | Japan . |
| 55-89192 | 12/1978 | Japan . |
| 61-160583 | 10/1986 | Japan . |
| 62-285328 | 12/1987 | Japan . |
| 63-195493 | 12/1988 | Japan . |
| 2-260098 | 10/1990 | Japan . |
| 4-20192 | 2/1992 | Japan . |

(List continued on next page.)

OTHER PUBLICATIONS

Patent Abstracts of Japan, vol. 105, No. 246 (E–1081),Jun. 24, 1991; JP–A–03 077219 (Omron Corp.), Apr. 2, 1991.

*Primary Examiner*—Glen Swann
*Attorney, Agent, or Firm*—Townsend and Townsend and Crew LLP

[57] ABSTRACT

The present invention relates to a theft preventive apparatus used as attached to a commodity or the like exhibited in a shop, for outputting an alarm when detached therefrom.

Conventionally, an alarm output device for outputting alarm information comprises a speaker for giving an alarm sound. However, it is impossible, where a plurality of theft prevention apparatus are arranged close to one another, to determine instantly which theft prevention apparatus is giving the alarm sound. The theft preventive apparatus of this invention comprises a box (2) attachable to an object of theft prevention (E) and including detecting means (P) for detecting a preliminary stealing act, and alarm output means (Q) for outputting alarm information based on detection information from the detecting means (P), said box (2) housing light emitting means (20) for emitting light based on the detection information from the detecting means (P) outwardly of said box (2). Even if a plurality of theft preventive apparatus are arranged close to one another, an instant determination may be made as to which one of theft prevention apparatus is outputting alarm information, by observing which theft preventive apparatus is emitting light.

17 Claims, 27 Drawing Sheets

FOREIGN PATENT DOCUMENTS

| | | |
|---|---|---|
| 4-211897 | 8/1992 | Japan . |
| 4-108286 | 9/1992 | Japan . |
| 1015700 | 1/1966 | United Kingdom . |
| 2137391 | 10/1984 | United Kingdom . |
| 2205426 | 12/1988 | United Kingdom . |
| 90/09648 | 8/1990 | WIPO . |
| 91/13416 | 9/1991 | WIPO . |
| 95/06924 | 3/1995 | WIPO . |

(a)

103
130
130a
1
2
131
132
5(U)
5b
a
6
6a
148b
2
5a
42a
43(U)
47a(G)
148
141a
47
4
41
140a
141c
141
49
142c
140b
141b
5d
142
5e
142b
141d
142d
47b(G)
142a

THEFT PREVENTIVE APPARATUS HAVING ALARM OUTPUT

[TECHNICAL FIELD]

The present invention relates to theft preventive apparatus, and particularly to a theft preventive apparatus comprising a box attached to an object of theft prevention and having a detecting device for detecting a preliminary stealing act, and an alarm output device for outputting alarm information based on detection information from the detecting device.

[BACKGROUND ART]

Such a theft preventive apparatus is used as attached to an object of theft prevention such as a commodity displayed in a shop, for example, and outputs alarm information when a preliminary stealing act is committed against the object of theft prevention.

The preliminary stealing act refers to an attempt to take an object of theft prevention to which the theft prevention apparatus is attached out of the shop, an attempt to remove the theft prevention apparatus from the object of theft prevention, or the like.

The box of the theft prevention apparatus has a detecting device for detecting the above preliminary stealing act, and outputs alarm information based on the detection information from the detecting device.

The mode of detecting the above preliminary stealing act, generally, comprises receiving an electric wave from a transmitter installed adjacent an entrance of a shop, to detect an attempt to take an object of theft prevention to which the theft preventive apparatus is attached out of the shop, or using a detecting device mounted in the theft prevention apparatus for detecting whether it has been detached from the object of theft prevention, to detect an act of detaching the theft prevention apparatus from the object of theft prevention.

The mode of outputting the alarm information for the above alarm, conventionally, comprises a speaker (buzzer) or the like mounted in the theft preventive apparatus itself to give an alarm sound, or the theft preventive apparatus transmitting an electric wave signal, and a receiver device installed in a predetermined location (out side the theft preventive apparatus) receiving the electric wave signal and giving an alarm sound or the like.

That is, conventionally, the alarm output device for outputting alarm information comprises a speaker for giving an alarm sound or a transmitter for transmitting an electric wave signal.

However, with the conventional construction noted above, it is impossible, where a plurality of theft prevention apparatus are arranged close to one another, to determine instantly which theft prevention apparatus is giving the alarm sound or which theft prevention apparatus is giving the electric wave signal. Thus, improvement is desired.

The present invention has been made having regard to the state of the art noted above, and its object is to provide a theft preventive apparatus for enabling instant determination which one of theft prevention apparatus is outputting alarm information.

A further object of the present invention is to provide a theft preventive apparatus having little chance of malfunction, capable of reliably detecting whether the theft preventive apparatus has been detached or not, and having a high yield of manufacture.

[DISCLOSURE OF THE INVENTION]

A theft preventive apparatus according to the present invention comprises a box attachable to an object of theft prevention and including detecting means for detecting a preliminary stealing act, and alarm output means for outputting alarm information based on detection information from the detecting means, the box housing light emitting means for emitting light based on the detection information from the detecting means outwardly of the box.

With this construction, when a preliminary stealing act is committed, the alarm output means outputs alarm information (alarm sound or electric wave signal), and the light emitting means emits light outwardly of the box.

Consequently, even if a plurality of theft preventive apparatus are arranged close to one another, an instant determination may be made as to which one of theft prevention apparatus is outputting alarm information, by observing which theft preventive apparatus is emitting light.

Preferably, the box includes a light window disposed on a corner thereof for releasing the light from the light emitting means.

According to this construction, since a light window is disposed on a corner of the box, the light emitted from the box may be seen from a plurality of directions. Where, as shown in FIG. 2 for example, a light window 34 is provided on a corner of box 2, the light window 34 lies adjacent a side surface 2*d* and a side surface 2*e*. Even if the side surface 2*d* is hidden by the object of theft prevention or the like, the light window 34 is visible from the direction of side surface 2*e*.

Consequently, even if one direction is blocked, light is visible from the other direction, to render the theft preventive apparatus convenient.

Further, light window may include light distributing means for distributing the light from one light emitting means in directions of side surfaces of the box adjacent the light window.

According to this construction, the light emitted from one light emitting means is distributed by the distributing means in the directions of side surfaces (a plurality of surfaces) of the box adjacent the light window. That is, the light emitted from one light emitting means is released in a plurality of directions.

Consequently, it is unnecessary to provide a plurality of light emitting means for release in a plurality of directions. Thus, power consumption is reduced while maintaining the feature of releasing light in a plurality of direction.

Further, the detecting means of the present invention may include receiver means mounted in the box for receiving a medium of information communication transmitted from a transmitter installed in a particular location, and the alarm output means include alarm sound output means for outputting an alarm sound based on detection information from the receiver means.

With this construction, an alarm sound and an alarm signal are outputted when a preliminary stealing act is committed, thereby to notify the preliminary stealing act positively.

Further, it is preferable that the alarm sound output means is constructed not to transmit the medium of information communication transmitted from the transmitter.

With this construction, when the alarm sound output means operates to sound the alarm, it does not send the same medium as the medium for information communication transmitted from the transmitter installed in a predetermined location. Thus, even where theft prevention apparatus are disposed close to one another, the operation of the alarm sound output means does not cause malfunctioning of the receiver means of the other theft prevention apparatus.

Consequently, malfunctioning of the theft preventive apparatus is avoided to promote reliability of the theft preventive apparatus.

Further, the alarm sound output means may comprise a piezoelectric buzzer.

With this construction, since a piezoelectric buzzer is used as the alarm sound output means, the alarm sound output means may be formed thin and lightweight.

Consequently, the theft preventive apparatus may be formed thin and lightweight.

Further, the box box may house a battery for supplying power to the alarm sound output means and the alarm sound output means opposed to each other, and a flat terminal unit having a terminal connected to a terminal of the battery and a terminal connected to an electrode of the alarm sound output means is disposed between the battery and the alarm sound output means.

According to this construction, the battery (button type or coin type) and piezoelectric buzzer are opposed to each other, and a plate-like terminal unit having a terminal connected to an electrode of the battery and a terminal connected to an electrode of the piezoelectric buzzer is provided between the battery and piezoelectric buzzer. Thus, three types of flat components (battery, piezoelectric buzzer and terminal unit) are arranged in superposition within the box.

Consequently, the theft preventive apparatus may be formed very thin.

Further, the alarm sound output means may output an intermittent sound as alarm sound.

This construction facilitates recognition of the alarm sound of the theft preventive apparatus, and reduces power consumption of the theft preventive apparatus, thereby promoting efficiency of the theft preventive apparatus.

Consequently, shop assistants and the like recognizes the alarm sound with ease. Power consumption of the theft preventive apparatus is less than where the alarm sound is outputted any time.

The box may have sound release openings formed in a side surface thereof for releasing the alarm sound outputted from the alarm sound output means outside the box.

With this construction, the alarm sound outputted from the alarm sound output means is released through the openings in the side surface of the box. The alarm sound release openings are difficult to block up, compared with the case where such openings are formed in a front surface or bottom surface of the box. That is, when the theft preventive apparatus is formed thin, the side surfaces of the box have a smaller width than the front surface and bottom surface. If the openings were formed in the front surface or bottom surface of the box, it would be possible to block up the openings easily with fingers or the like (such an act is taken to stifle the alarm sound). However, the openings are difficult to block up by providing the openings in the side surface of the box.

Consequently, it is now possible to prevent effectively a preliminary stealing act to take the object of theft prevention outside the shop; with fingers blocking up the openings to suppress the alarm sound.

The box may have a shield wall mounted therein for shielding components in the box against exposure through the openings.

With this construction, since the shield wall is provided to shield components in the box against exposure through the openings, the shield can bar entry of a foreign object inserted through an opening into the box. The alarm sound generated in the box is guided round the shield wall to the openings to be released outside the box.

Consequently, it is now possible to prevent effectively a preliminary stealing act to destroy the components in the box by inserting a foreign object through an opening.

Further, the present invention may be modified such that the receiver means comprises a resonance antenna for a theft preventive apparatus for outputting a signal to operate the alarm means upon receipt of the electric wave from the transmitter, and has a coil, a capacitor and a resistor in parallel connection.

With this construction, the resistor is connected in parallel to the coil and capacitor already in parallel connection. This resonance antenna has what is known as Q-value of a resonator lowered, whereby the resonance antenna has a reduced frequency selectivity. Thus, the reception sensitivity of the resonance antenna is little variable with variations in resonance frequency due to variations in circuit constant caused by variations in the coil and capacitor.

With this construction, therefore, the reception sensitivity of the resonance antenna is little variable with variations in resonance frequency. This minimizes variations in reception sensitivity occurring with different resonance antennas, thereby to promote yield in the manufacture of resonance antennas for use in theft preventive apparatus.

[BEST MODE FOR CARRYING OUT THE INVENTION]

An embodiment of the present invention will be described hereinafter with reference to the drawings.

Figure 2A:
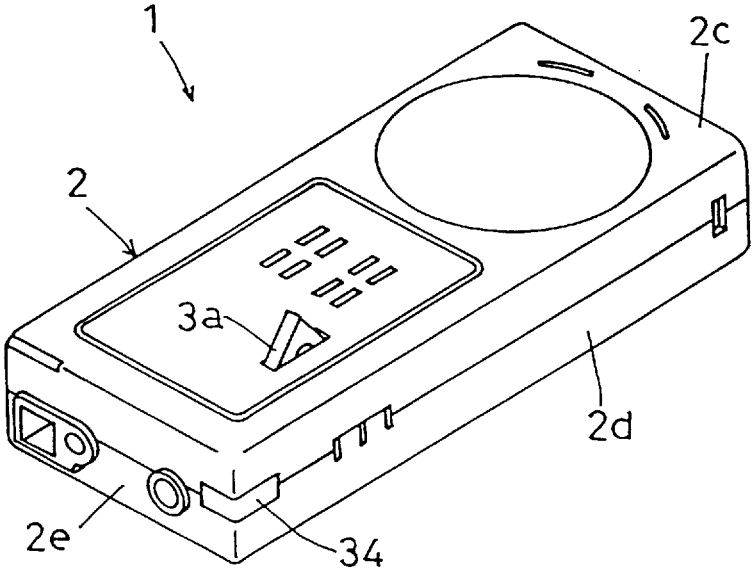
Figure 2B:
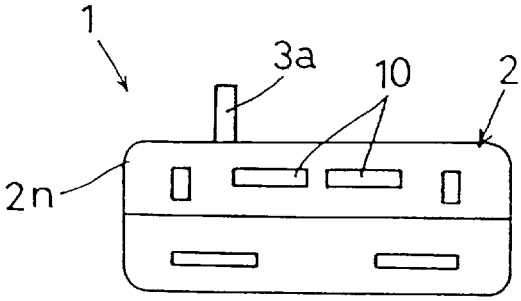

As shown in FIG. 2, a sensor tag 1 acting as a theft preventive apparatus includes a box 2 attached with a top surface (contact surface) thereof contacting an object of theft prevention, not shown. FIG. 2 (*a*) is a perspective view of the sensor tag 1, and FIG. 2 (*b*) shows a rear surface 2*n* of the sensor tag 1.

The sensor tag 1 includes a switch 3 having a pivotable operated portion 3*a* biased to a projection position w projected from the contact surface 2*c*. This switch 3 is turned ON/OFF by pivotal movement of the operated portion 3*a*. Consequently, the operated portion 3*a* of the switch 3 pivots by presence or absence of the object of theft prevention to turn the switch 3 ON/OFF, to detect whether the sensor tag 1 has been detached from the object of theft prevention or not.

Figure 1:
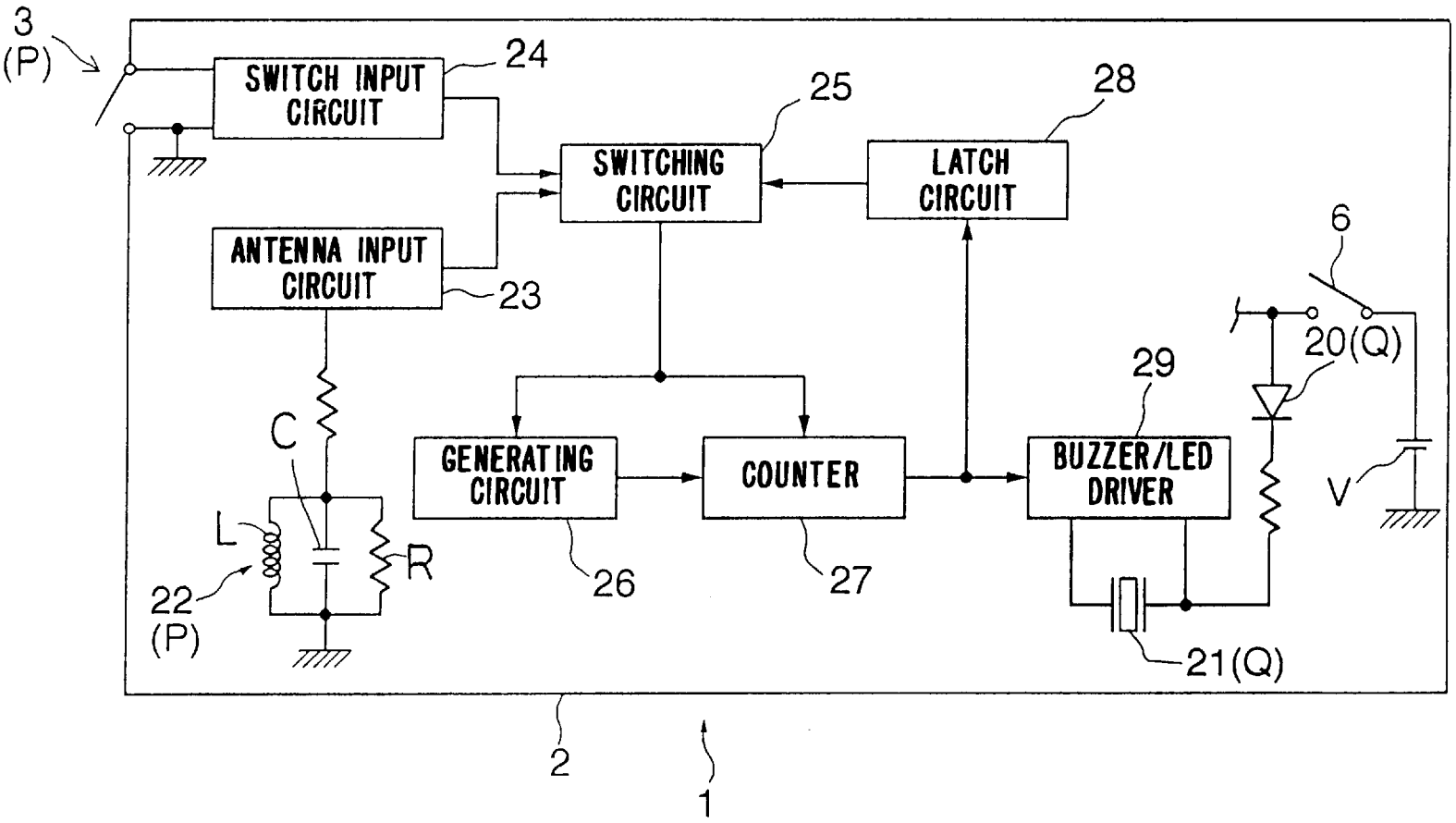
FIG. 1 is a schematic view of a theft preventive apparatus in an embodiment of the present invention, FIGS. 2 (*a*), (*b*) are explanatory views of outward appearances of the theft preventive device of FIG. 1.

As shown in FIG. 1, the box 2 of sensor tag 1 contains an LED lamp (chip LED) 20 acting as a light emitting device; a piezoelectric buzzer 21; a resonance antenna 22 including a coil L, a capacitor C and a resistor R; an antenna input circuit 23 for outputting a reception signal when the resonance antenna 22 is in signal receiving state; a switch input circuit 24 for outputting OFF signal indicating OFF state of switch 3; a switching circuit 25 for outputting a control signal upon receipt of the reception signal from the antenna input circuit 23 or OFF signal from the switch input circuit 24; a generating circuit 26 which starts generating pulses upon input of the control signal from the switching circuit 25; a counter 27 which starts counting the pulses generated by the generating circuit 26 upon input of the control signal from the switching circuit 25, and outputs a count completion signal when the count exceeds a predetermined number; a latch circuit 28 responsive to input of the count completion signal to maintain switching circuit 25 in the state of receiving the above reception signal or OFF signal; a buzzer/LED driver 29 for lighting the LED lamp 20 and sounding the piezoelectric buzzer 21 upon input of the count completion signal of counter 27; a flat battery (button type or coin type) V for supplying power to the respective circuits in the box 2; and a power supply switch 6 for turning on and off the power supply from the battery V to the circuits.

Figure 19:
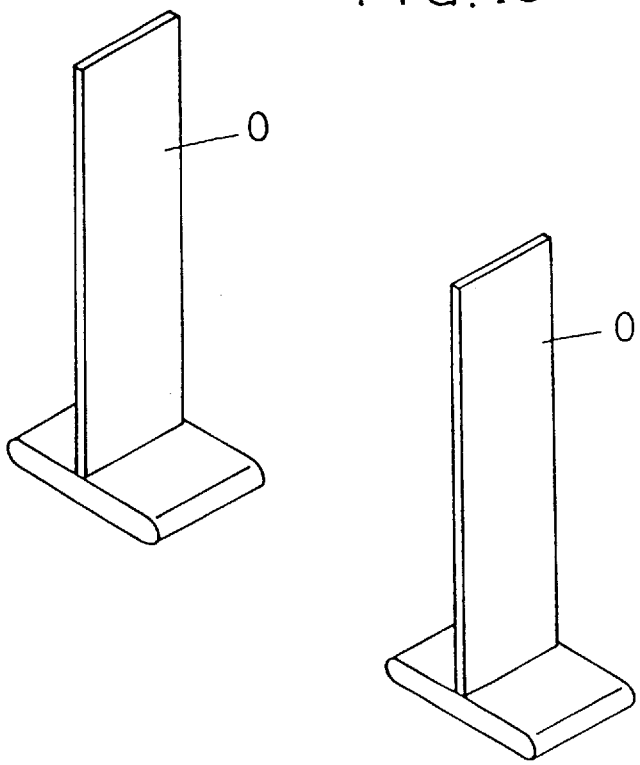
FIG. 19 is a perspective view of an outward appearance of a transmitter.

With the circuit having the above construction, the piezoelectric buzzer 21 mounted in the box 2 sounds when, with the power supply switch 6 turned on, the switch 3 is turn off, or the sensor tag 1 is passed through a position where a pair of panel-like transmitters O as shown in FIG. 19 are installed at opposite sides of an entrance of a shop.

In FIG. 2, 10 denotes openings formed in a side surface 2*n* of the box 2 for releasing the sound of the piezoelectric buzzer 21 outwardly of the box 2.

A process for causing the piezoelectric buzzer 21 to begin to sound will be described briefly hereinafter.

The sensor tag 1 is attached to object of theft prevention, with the switch 3 turned ON to set in operative state (to turn on the switch 6). When the sensor tag 1 is detached from the object of theft prevention E, the switch 3 becomes OFF. The switch input circuit 24 detects the OFF state.

Upon detection of the OFF state of switch 3, the switch input circuit 24 outputs the OFF signal to the switching circuit 25.

While the OFF signal is inputted from the switch input circuit 24, the switching circuit 25 sends the control signal to the generating circuit 26 and counter 27. While the control signal is received, the generating circuit 26 generates pulses, and the counter 27 counts the pulses generated by the generating circuit 26. When the control signal stops, the generating circuit 26 stops generating pulses, and the counter 27 stops counting and resets a pulse count.

Each time a predetermined count of pulses is reached, the counter 27 sends one pulse signal as a count completion signal to the latch circuit 26 and buzzer/LED driver 29.

While this count completion signal is received, the buzzer/LED driver 29 sounds the piezoelectric buzzer 21, and lights the LED lamp 20.

On the other hand, the latch circuit 28 receives the count completion signal from the counter 27, and maintains the switching circuit 25 in the state of receiving the above OFF signal. The switching circuit 25 thereby continues sending the control signal to the generating circuit 26 and counter 27.

In other words, the buzzer/LED driver 29 sounds the piezoelectric buzzer 21 and lights the LED lamp 20 after the switching circuit 25 receives the OFF signal and the counter 27 completes counting up to the predetermined count. Thus, unless the OFF signal is continuously received over a fixed time, the piezoelectric buzzer 21 and LED lamp 20 remain out of operation. The prevents malfunctioning due to noise or the like.

The switching circuit 25 continues sending the control signal once the counter 27 outputs the count completion signal, regardless of presence or absence of the OFF signal from the wire unit input circuit 24. Consequently, until the power supply switch 6 is turned off, the piezoelectric buzzer 21 continues outputting intermittent sound synchronously with the count completion signal from the counter 27, and the LED lamp 20 continues flashing synchronously with the count completion signal from the counter 27.

On the other hand, when the sensor tag 1 passes through a position where the transmitters O are installed, the resonance antenna 22 generates an electromotive force with an electric wave from the transmitters O. The antenna input circuit 23 detects the electromotive force, and outputs the reception signal to the switching circuit 25.

The operation of each circuit after the switching circuit 25 receives the reception signal is the same as when the above-mentioned switch 3 becomes OFF state, and will not be described again.

Thus, the switch 3 and resonance antenna 22 act as a detecting device P for a preliminary stealing act. The piezoelectric buzzer 21 and LED lamp 20 act as an alarm output device Q for outputting alarm information based on detection information from the detecting device P.

That is, the resonance antenna 22 acts as a reception device for receiving a medium (electric wave) of information communication sent from the transmitters installed in a particular location. The piezoelectric buzzer 21 acts as an alarm sound output device to output an alarm sound based on reception information of the reception device (resonance antenna 22), but not to transmit the medium of information communication (electric wave signal) sent from the transmitters O installed in the particular location.

The construction and operation of each component will be described hereinafter.

Figure 3:
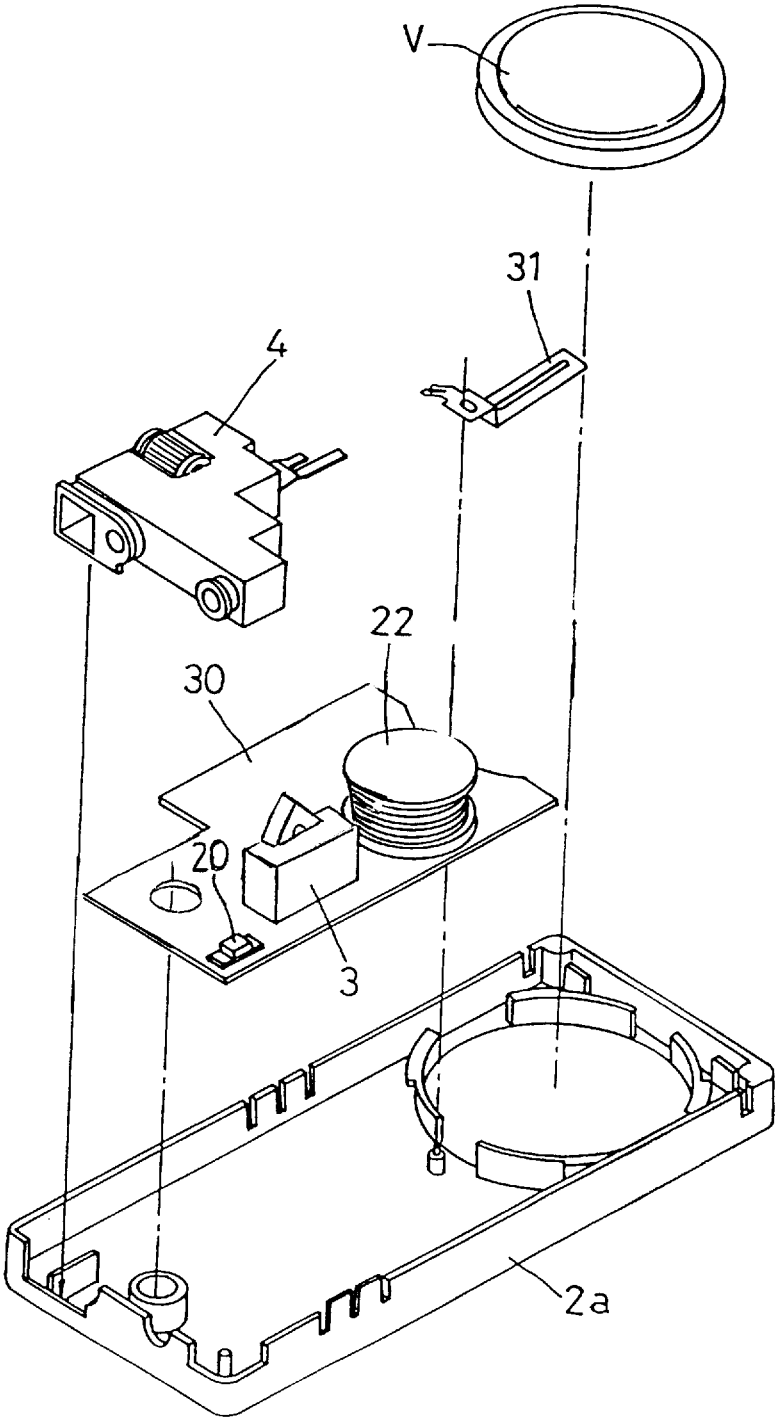
FIG. 3 is an explanatory perspective view of bottom case components in the embodiment of FIG. 1.
Figure 4:
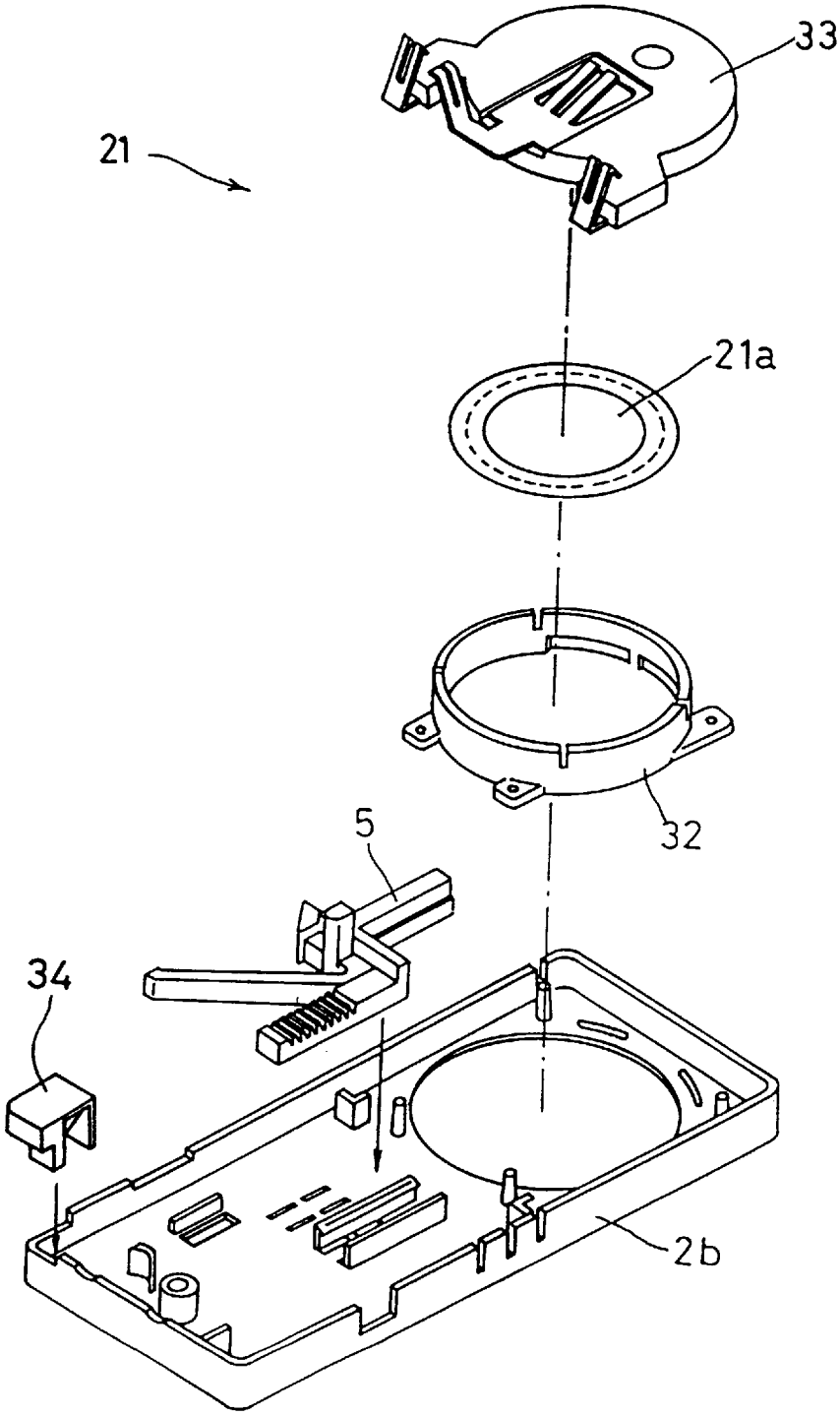
FIG. 4 is an explanatory perspective view of top case components in the embodiment of FIG. 1.

As shown in FIGS. 3 and 4, the box 2 includes a bottom case 2*a* and a top case 2*b*.

The bottom case 2*a* has a circuit board 30 carrying the switch 3, LED lamp 20, antenna 22 and various electronic components, a jack unit 4, a terminal 31 for plus electrode connection of battery V, and the battery V.

The top case 2*b* has, assembled thereto, a speaker housing 32 containing the piezoelectric buzzer 21, the piezoelectric buzzer 21, a flat terminal unit 33, an LED window (light window) 34 for releasing light from the LED lamp 20, and a slider 5.

The sensor tag 1 shown in FIG. 2 is formed by joining the bottom case 2*a* and top case 2*b* by ultrasonic welding.

The battery V and piezoelectric buzzer 21 are opposed to each other, and the terminal unit 33 is disposed between the battery V and piezoelectric buzzer 21.

Figure 6:
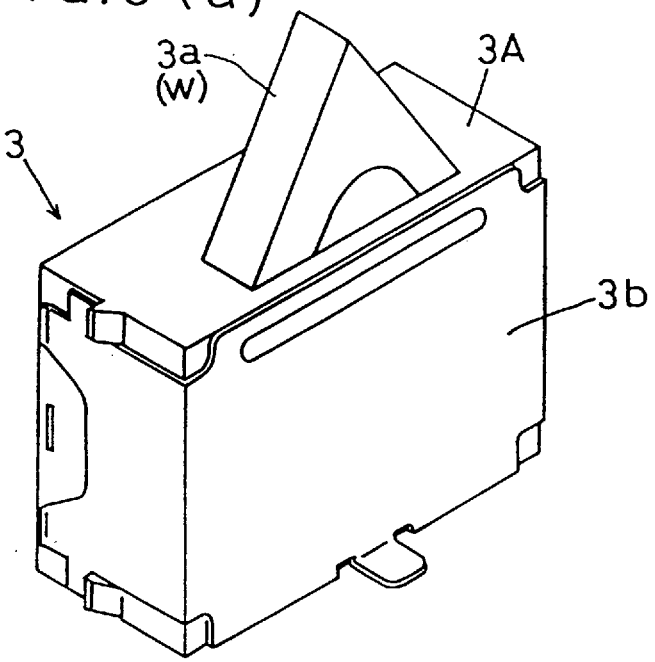
Figure 6:
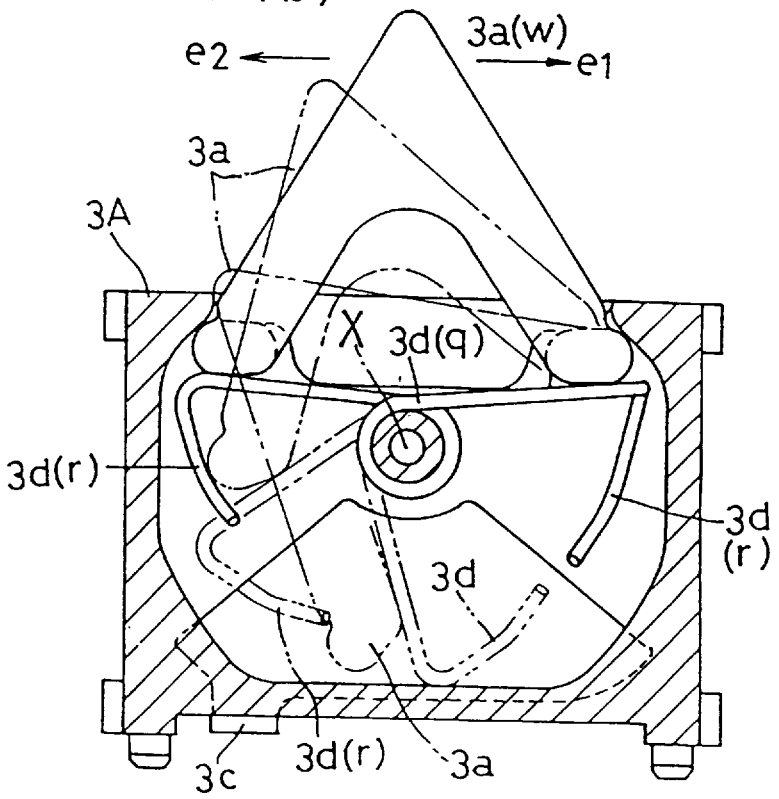
Figure 6C:
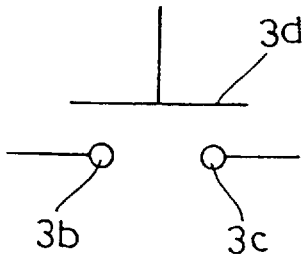

As shown in FIG. 6, the switch 3 includes a box-like frame 3A formed of a non-conductive material such as a resin to define an open side; the triangular operated portion 3*a;* a substantially C-shaped first terminal 3*b* formed of metal and attached to the frame 3A to close the opening; a second terminal 3*c* formed of metal and attached to an inner surface of the frame 3A; and a coil spring 3*d* supported on a boss defined by the frame 3A to be pivotable about a cross axis X. The operated portion 3*a* of switch 3 is held between the frame 3A and coil spring 3*d* to be pivotable in two opposite directions e1, e2 and biased to projection position w projecting from the contact surface 2*c* of the frame 3A by opposite end portions of coil spring 3*d* extending from a middle portion q thereof.

Further, the coil spring 3*d* acts as a connector piece for connecting and disconnecting the first terminal 3*b* and second terminal 3*c* of switch 3. That is, the middle portion q of coil spring 3*d* constantly is in contact with the first terminal 3*b*. When the operated portion 3*a* pushes down an end r of coil spring 3*d,* the end r of coil spring 3*d* moves into contact with the terminal 3*c*.

FIG. 6 (*a*) is a perspective view of switch 3, and (*b*) is a view showing a circuit construction of switch 3.

Figure 7A:
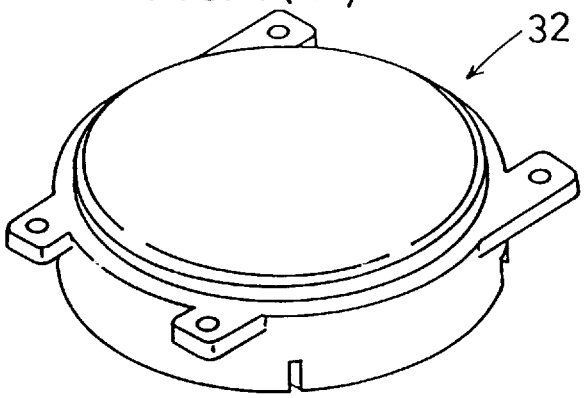
Figure 7B:
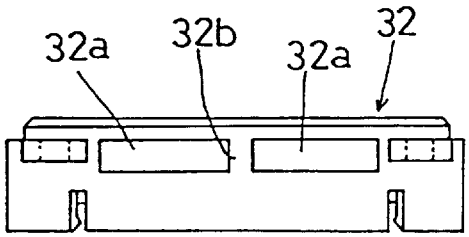
Figure 8A:
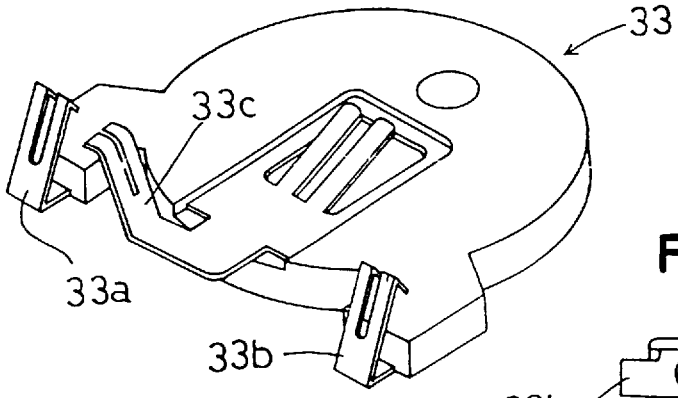
Figure 8B:
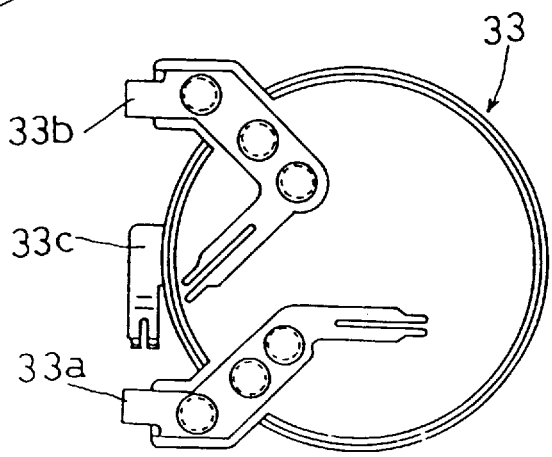

As shown in FIG. 7, the speaker housing 32 has, press fit therein, the piezoelectric buzzer 21 and the terminal unit 33 shown in FIG. 8. The sound generated from the piezoelectric buzzer 21 is released through the openings 32*a* to the outside.

In the drawings, 32*b* denotes a shielding wall for shielding the components in the box 2 against exposure to the outside through the openings 10, i.e. for preventing entry of foreign matters through the openings 10.

As shown in FIG. 8, the terminal unit 33 has terminals 33*a,* 33*b* connected to electrodes (+, −) of the piezoelectric buzzer 21 when press fit in the speaker housing 32, and a terminal 33*c* connected to a minus electrode of battery V when the bottom case 2*a* and top case 2*b* are joined by ultrasonic welding.

FIG. 7 (*a*) is a perspective view of the speaker housing 32, FIG. 7 (*b*) is a rear view of the speaker housing 32, FIG. 8 (*a*) is a perspective view of the terminal unit 33, and FIG. 8 (*b*) is a bottom view of the terminal unit 33.

Figure 9:
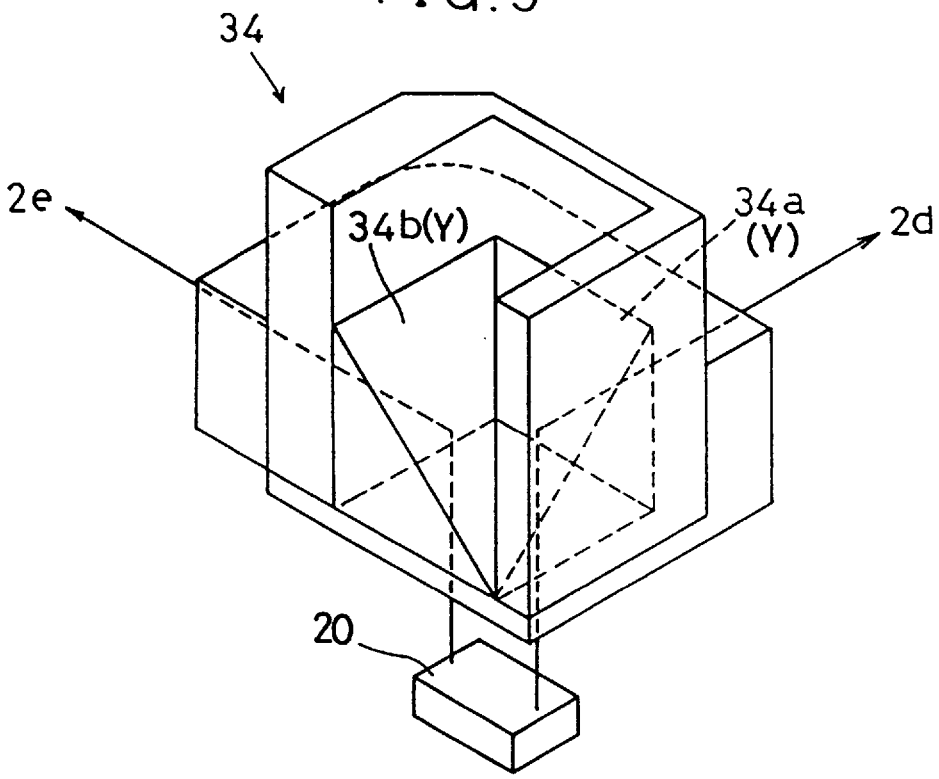
FIG. 9 is a perspective view of an LED window, FIGS. 10 (*a*), (*b*) are explanatory views of outward appearances of a jack unit in the embodiment of FIG. 1, FIGS. 11 (*a*), (*b*) are explanatory views of a set button pin in the embodiment of FIG. 1.

The LED window 34 mounted in a comer of the box 2 has slant surfaces 34*a*, 34*b,* as shown in FIG. 9, for distributing light from one LED lamp 20 in directions of side surfaces 2*d,* 2*e* of box 2 adjacent the LED window 34.

Thus, the slant surfaces 34*a,* 34*b* act as a distributing device Y for distributing the light from the LED lamp 20 in the directions of side surfaces 2*d,* 2*e* of the box 2.

Figure 10A:
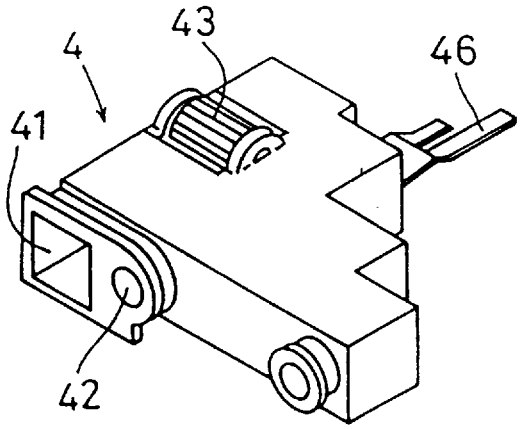
Figure 10B:
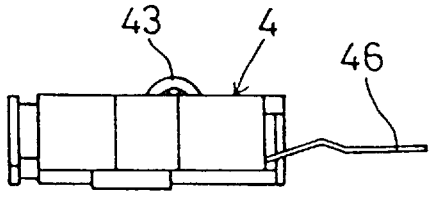

As shown in FIG. 10, the jack unit 4 has a key insertion hole 41 for receiving a rack K1 of a disengaging key K (see FIG. 18), and a set button pin insertion hole 42 for receiving a projecting pin K2 of key K.

Figure 11A:
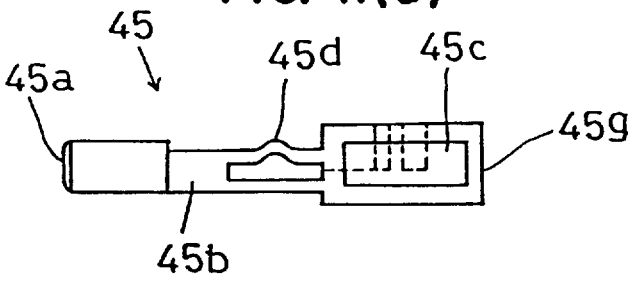
Figure 11B:
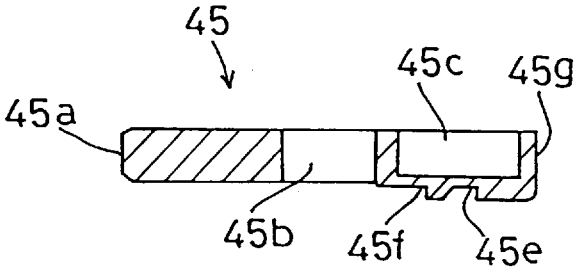
Figure 12:
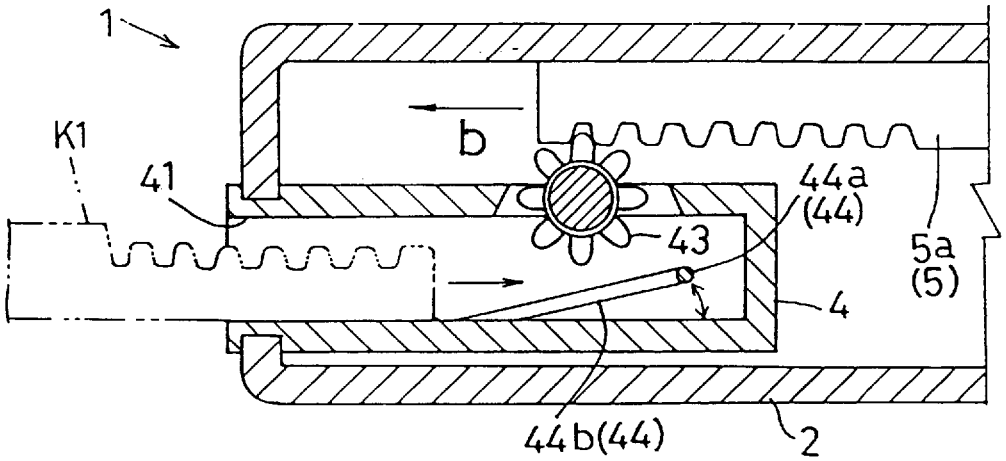
FIG. 12 is an explanatory view of the jack unit in the embodiment of FIG. 1.

As shown in FIG. 12, the key insertion hole 41 has, mounted therein, a pinion gear 43 rotatable by the rack K1 inserted into the key insertion hole 41, and a movement check spring 44 for checking movement of a set button pin 45 mounted in the set button pin insertion hole 42 (see FIG. 11).

The pinion gear 43 is rotatably supported in the main body of jack unit 4, with a part thereof projecting into the key insertion hole 41, and the other part projecting outside the jack unit 4.

FIG. 10 (*a*) is a perspective view of the jack unit 4, and FIG. 10 (*b*) is a side view of the jack unit 4.

The set button pin insertion hole 42 has the set button pin 45 slidably mounted in the set button pin insertion hole 42. A contact spring 46 formed of metal is attached to an end of the set button pin insertion hole 42 to be vertically pivotable when pushed by the set button pin 45.

As shown in FIG. 11, the set button pin 45 includes an operated portion 45*a* pushed from outside the box 2, a positioning portion 45*b* for positioning the set button pin 45 in a particular location inside the set button pin insertion hole 42, a spring storing portion 45*c* storing a coil spring 47 for biasing the set button pin 45 in a direction opposite to the inserting direction of the set button pin 45, and an end 45*g* for pushing the contact spring 46 to swing the contact spring up and down.

FIG. 11 (*a*) is a plan view of the set button pin 45, and FIG. 11 (*b*) is a sectional view of the set button pin 45.

Figure 13:
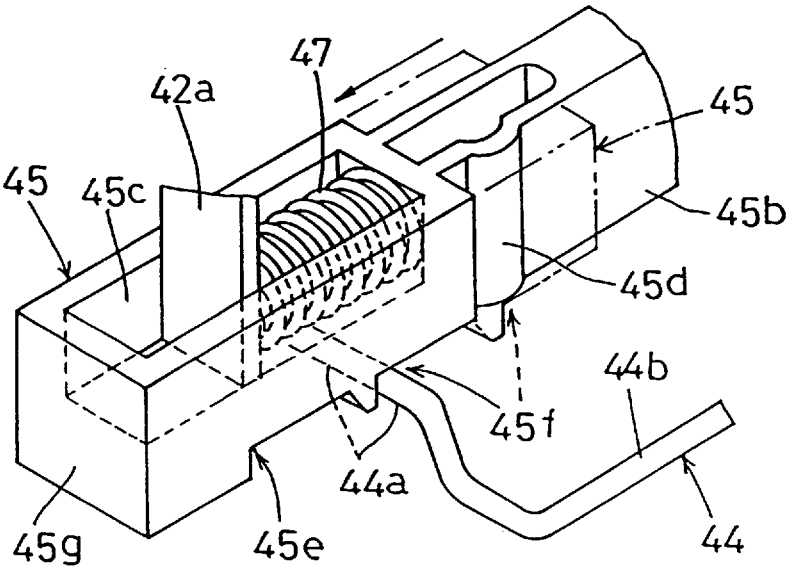
FIG. 13 is a perspective view of a principal portion of the embodiment of FIG. 1.

As shown in FIG. 13, a projection 42*a* is formed in a space defined by the spring storing portion 45*c* and inner walls of the set button pin insertion hole 42 to project from the inner walls of the set button pin insertion hole 42 to check movement in the sliding direction of the set button pin 45.

As shown in FIG. 13, the coil spring 47 is disposed between inner walls of the spring storing portion 45*c* and the projection 42*a*. Thus, as noted hereinbefore, the set button pin 45 is biased in the direction opposite to the inserting direction of the set button pin 45.

The positioning portion 45*b* of set button pin 45 has a positioning bulge 45*d* having elasticity to be movable in the projecting direction. An inner wall of the set button pin insertion hole 42 includes a recess 42*b* for engaging the positioning bulge 45*d* when the set button pin 45 is pushed.

When the set button pin 45 is pushed, the end 45*g* of set button pin 45 contacts the contact spring 46 to swing the contact spring 46 up and down. With this swinging movement, a free end of contact spring 46 touches the circuit board 30. As a result, the two terminals on the circuit board 30 are short-circuited.

The short circuit of the two terminals causes power to be supplied from battery V each circuit in the box 2. This contact spring 46 corresponds to the power supply switch 6 in FIG. 1.

As shown in FIGS. 12 and 13, the jack unit 4 has the movement check spring 44.

The movement check spring 44 is formed of a thin metal piece to be elastically deformable. One end is fixed to one side of the key insertion hole 41 to act as a proximal end, and the other end is a free end 44*a* pivotable through elastic deformation.

As shown in FIG. 13, when the set button pin 45 is pushed, the free end 44*a* of the movement check spring 44 is pressed by the elastic action of movement check spring 44, against an engaging portion 45*e* formed on an outer surface of the spring storing portion 45*c* of set button pin 45. An intermediate portion 44*b* between the proximal end and free end 44*a* of movement check spring 44 extends across the key insertion hole 41.

Figure 14:
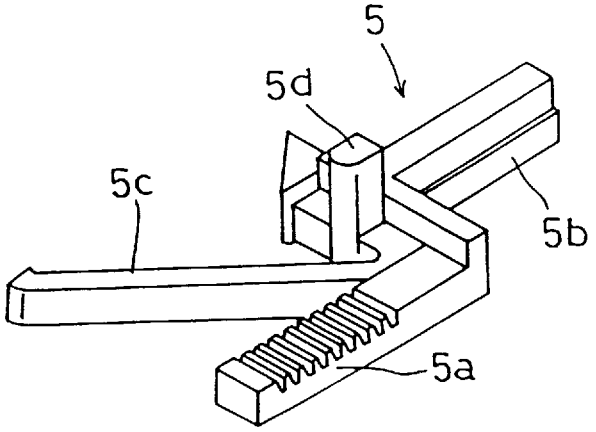
FIG. 14 is an explanatory view of an outward appearance of a slider in the embodiment of FIG. 1, FIGS. 15 (*a*), (*b*) are sectional views of the principal portion of the embodiment of FIG. 1, FIGS. 16 (*a*), (*b*) are sectional views of the principal portion of the embodiment of FIG. 1, FIGS. 17 (*a*), (*b*) are sectional views of the principal portion of the embodiment of FIG. 1.

Top case 2*b* includes a slider 5 (see FIG. 14) having a rack 5*a* meshed with the pinion gear 43 of jack unit 4.

Figure 5:
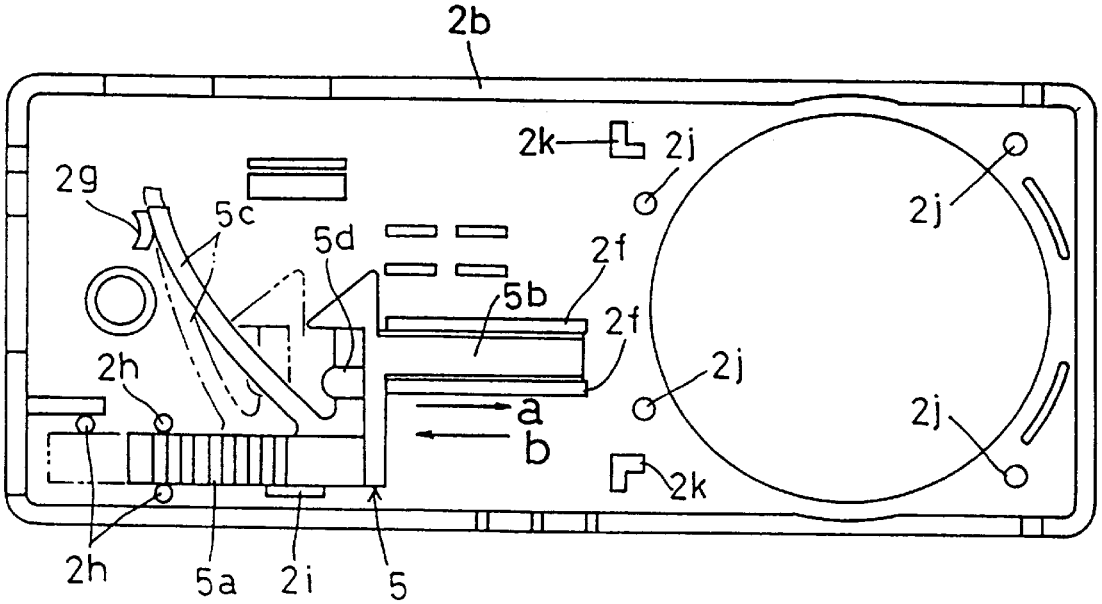
FIG. 5 is a plan view of the top case in the embodiment of FIG. 1, FIGS. 6 (*a*), (*b*), (*c*) are explanatory views of a switch in the embodiment of FIG. 1, FIGS. 7 (*a*), (*b*) are explanatory views of outward appearances of a speaker housing in the embodiment of FIG. 1, FIGS. 8 (*a*), (*b*) are explanatory views of outward appearances of a terminal unit in the embodiment of FIG. 1.

As shown in FIG. 5, the slider 5 has a proximal portion 5*b* thereof slidably engaging a guide portion 2*f* formed on an inner wall of the top case 2*b*, which is slidable in two directions indicated by arrows a, b. A forward end of an elastically deformable extension 5*c* extending from an intermediate portion between rack 5*a* and proximal portion 5*b* engages an engaging portion 2*g* of the top case 2*b*, so that the elasticity of the extension 5*c* applies a biasing force in the direction of arrow a.

In the drawings, 2*h* and 2*i* denote projections for preventing inclination of slider 5. 2*j* denotes projections for holding the speaker housing 32 in place. 2*k* denotes projections for reinforcing contact between terminals 33*a*, 33*b* and terminals on the circuit board 30. When the bottom case 2*a* and top case 2*b* are joined by ultrasonic welding, the projections 2*k* press the terminals 33*a*, 33*b* to the circuit board.

To start operation of the sensor tag 1, the set button pin 45 is pushed with the projection pin K2 of key K to turn on the power supply switch 6. A mechanism for maintaining the power supply switch 6 in the ON state will be described next.

Figure 15A:
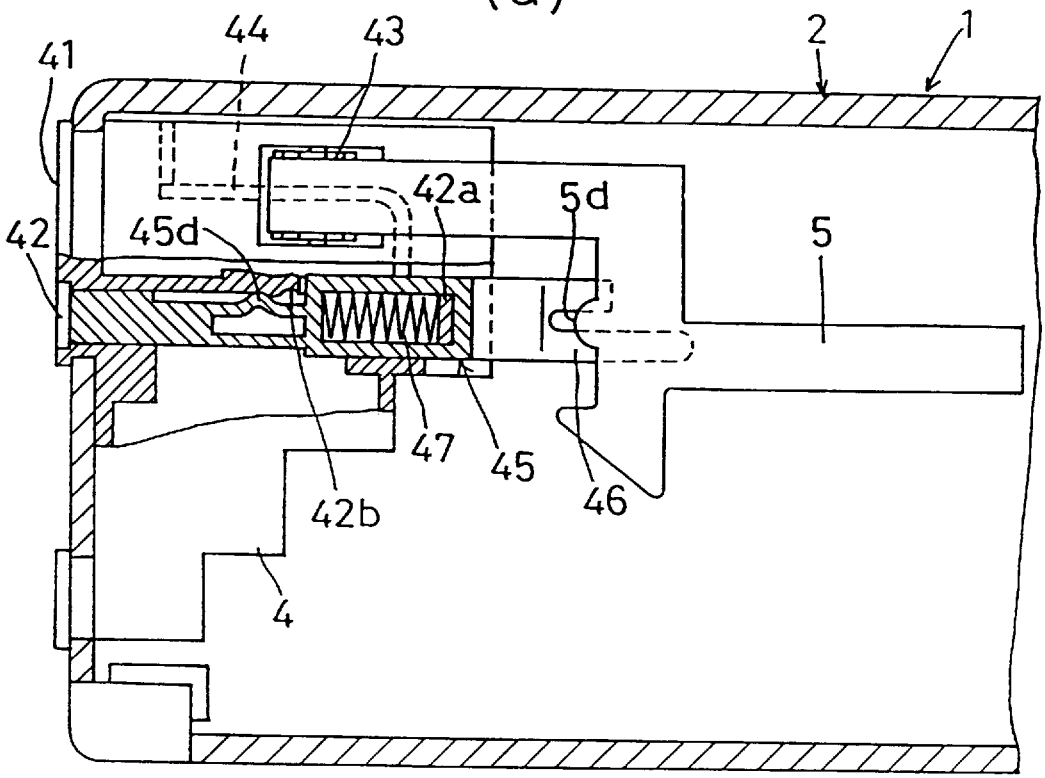
Figure 15B:
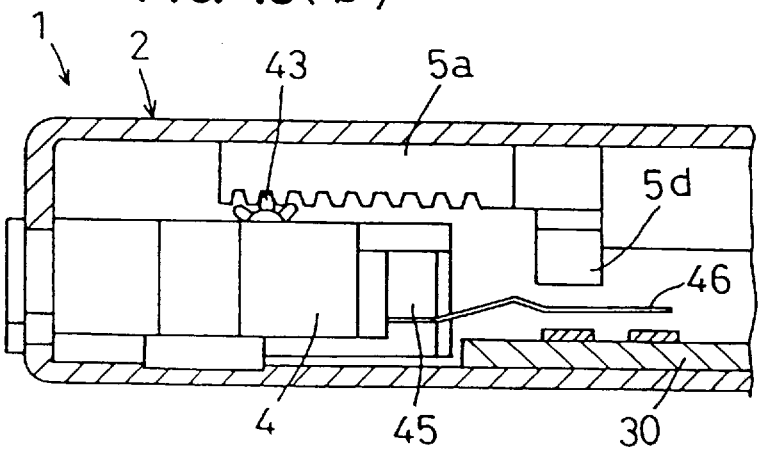

The set button pin 45 is maintained at first in the position shown in FIG. 15, with the free end of movement check spring 44 engaged with an engaging portion 45*f* of set button pin 45.

Figure 16A:
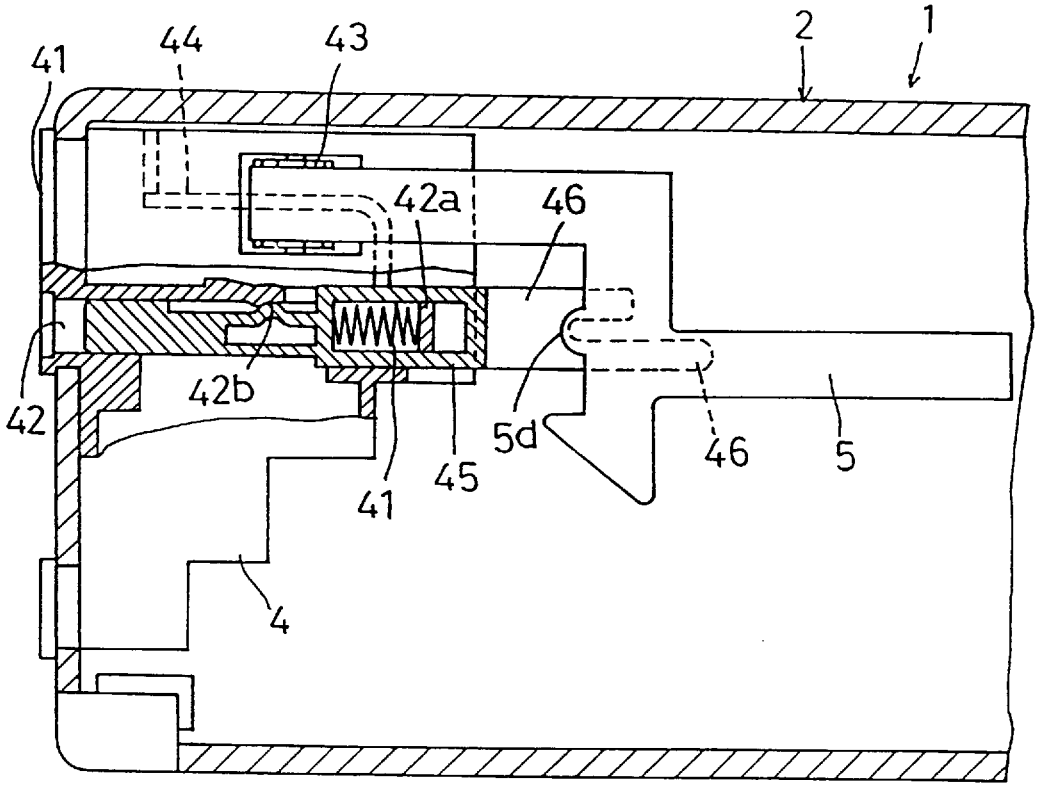
Figure 16B:
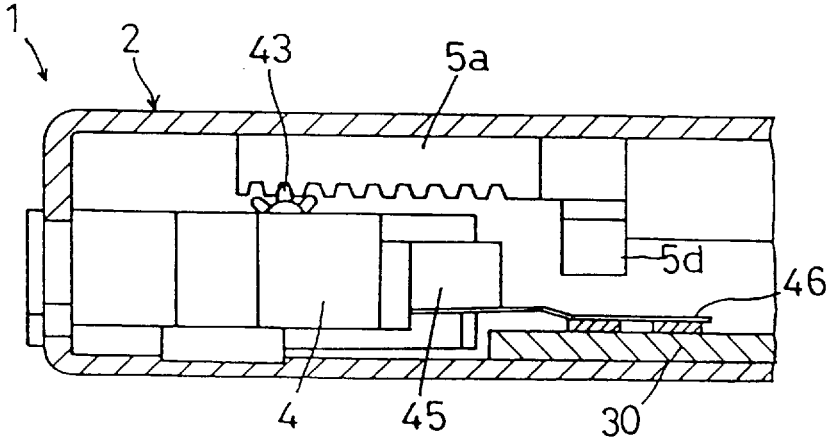

When the operated portion 45*a* of set button pin 45 in the jack unit 4 is pushed into the depth with the projection pin K2 of disengaging key K, as shown in FIG. 16, the end 45*g* of set button pin 45 contacts the contact spring 46, and swings the contact spring 46. With this swinging movement, the free end of contact spring 46 touches the circuit board, and causes a short circuit between the two terminals on the circuit board.

This turns off the power supply switch 6, and starts the power supply from the battery V to each circuit in the main case.

When the set button pin 45 is pushed then, the coil spring 47 is compressed to push back the set button pin 45 outside the box 2 (in the direction opposite to the inserting direction of set button pin 45). However, the engaging bulge 45*d* of set button pin 45 and engaging recess 42*d* of set button pin insertion hole 42 engage each other, and the free end 44*a* of movement check spring 44 extending from the key insertion hole 41 engages the engaging portion 45*e* on the outer surface of spring storing portion 45*c*. Consequently, that position is maintained against the biasing force of coil spring 47.

A mechanism for turning off the power supply switch 6 to stop the operation of sensor tag 1 will be described next.

In the state shown in FIG. 16, when the rack K1 is inserted into the key insertion hole 41, the rack K1 presses the movement check spring 44 extending across the key insertion hole 41, and rotates the pinion gear 43 meshed with the the rack K1.

Figure 17A:
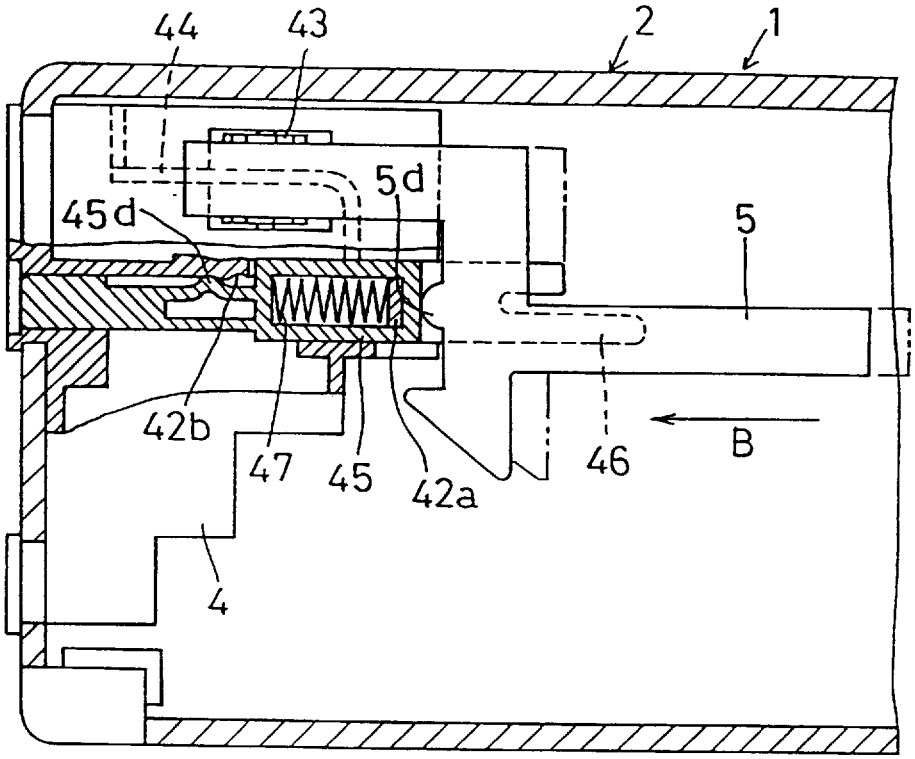
Figure 17B:
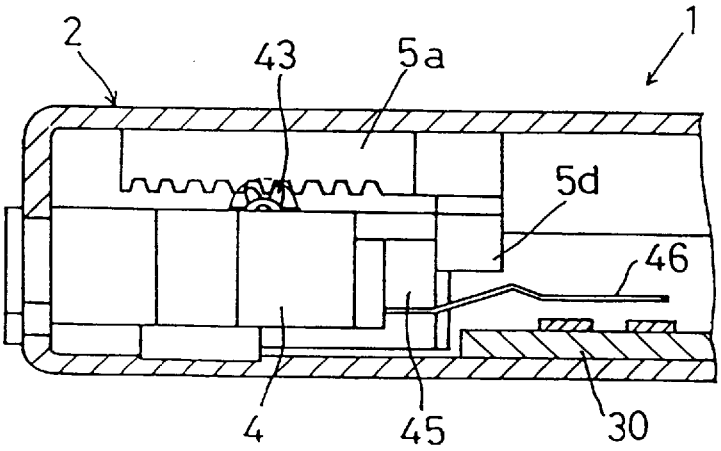

When the rack K1 presses the intermediate portion 44*b* of movement check spring 44, the intermediate portion 44*b* of movement check spring 44 pushed against a wall of the key insertion hole 41. As a result, the free end 44*a* of movement check spring 44 pivots downward, whereby the free end 44*a* and the engaging portion 45*e* of set button pin 45 are disengaged. When the pinion gear 43 is rotated by the rack K1, as shown in FIG. 17, the rotation of pinion gear 43 causes the slider 5 having the rack 5*a* engaged with the pinion gear 43 moves in the direction of arrow b.

The slider 5 has a presser portion 5*d* for contacting the end 45*g* of set button pin 45 with the sliding movement in the direction of arrow b of slider 5. When the presser portion 5*d* pushes the end 45*g* of set button pin 45, the set button pin 45 moves outwardly of the box 2 (in the direction opposite to the direction in which the set button pin 45 is inserted). Consequently, the engaging bulge 45*d* of set button pin 45 and engaging recess 42*b* of set button pin insertion hole 42 are disengaged.

As a result, by the return biasing force of coil spring 47 in the spring storing portion 45*c*, the set button pin 45 returns to the state before the projection pin K2 is inserted (the state of FIG. 15). The contact spring 46 is separated from the two terminals on the circuit board, thereby stopping the power supply from the battery V to each circuit in the box 2.

When the rack K1 is withdrawn from the key insertion hole 42, the slider 5 having slid in the direction of arrow b returns to the original position (the position in FIG. 15) under a biasing force acting in the direction of arrow a due to the elasticity of extension 5*c*.

FIG. 15, FIG. 16 and FIG. 17 (a) are sectional plan views. FIG. 15, FIG. 16 and FIG. 17 (*b*) are sectional side views.

(1) In the above embodiment, alarm information is outputted by lighting LED lamp 20 and sounding piezoelectric buzzer 21. However, the box 2 may have a transmitting device for transmitting an electric wave, with a device placed in a selected location for receiving the electric wave from the transmitting device and giving an alarm. In this case, alarm information is outputted by lighting LED lamp 20 and transmitting the electric wave from the transmitting device when the sensor tag 1 is detached from the object of theft prevention.

(2) In the above embodiment, LED window 34 is disposed in contact with the side surface 2*d* and side surface 2*e* of box 2, but may be disposed to contact other surfaces.

For example, an LED window may be provided on a corner formed by the side surface 2*c,* side surface 2*d* and side surface 2*e* to contact the side surface 2*c,* side surface 2*d* and side surface 2*e.* In this case, the LED window needs to have three slant surfaces for distributing the light from the single LED lamp 20 in three directions.

(3) In the above embodiment, the alarm outputting device comprise the piezoelectric buzzer (piezoelectric type buzzer) 21, but is not limited to the piezoelectric type. A different type of buzzer such as the electrostatic type (but not transmitting an electric wave) may be used.

(4) In the above embodiment, openings 10 are formed in the side surface 2*n* of box 2. However, openings may be formed in a different side surface (such as side surface 2*d*) as well for releasing the alarm sound.

Then, the openings cannot be blocked up easily, thereby positively preventing a preliminary stealing act to cancel the alarm sound and walk out with the object of theft prevention.

(5) A different embodiment of the present invention will be described with reference to the drawings.

Figure 21A:
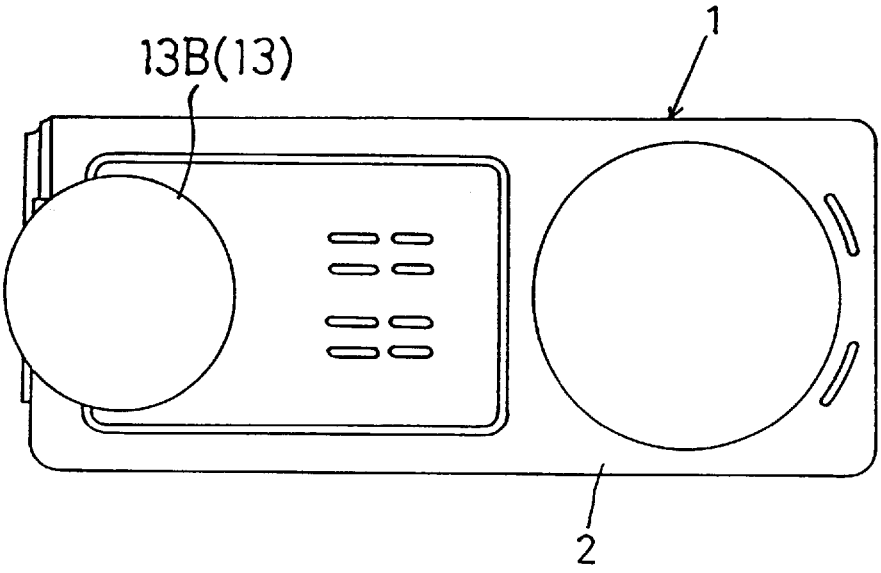
Figure 21B:
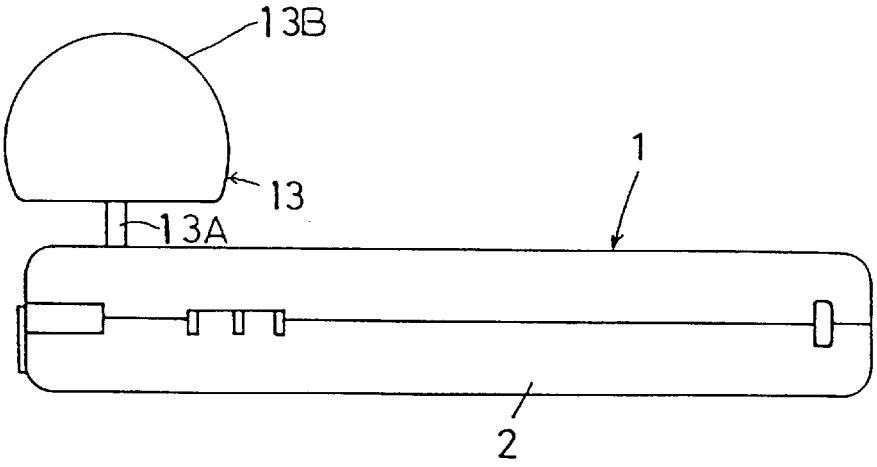

As shown in a plan view of FIG. 21 (*a*) and a side view of FIG. 21 (*b*), a sensor tag 1 acting as a theft preventive apparatus includes a mounting pin 13 for attaching a box 2 to an object of theft prevention.

Figure 22A:
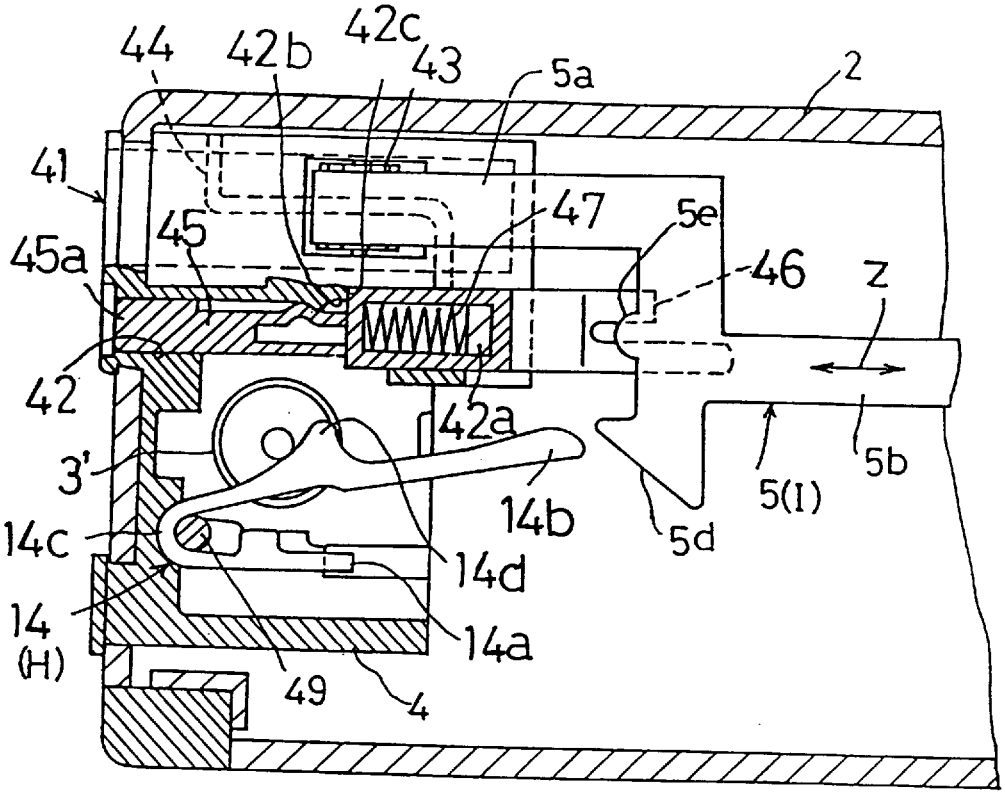
Figure 22B:
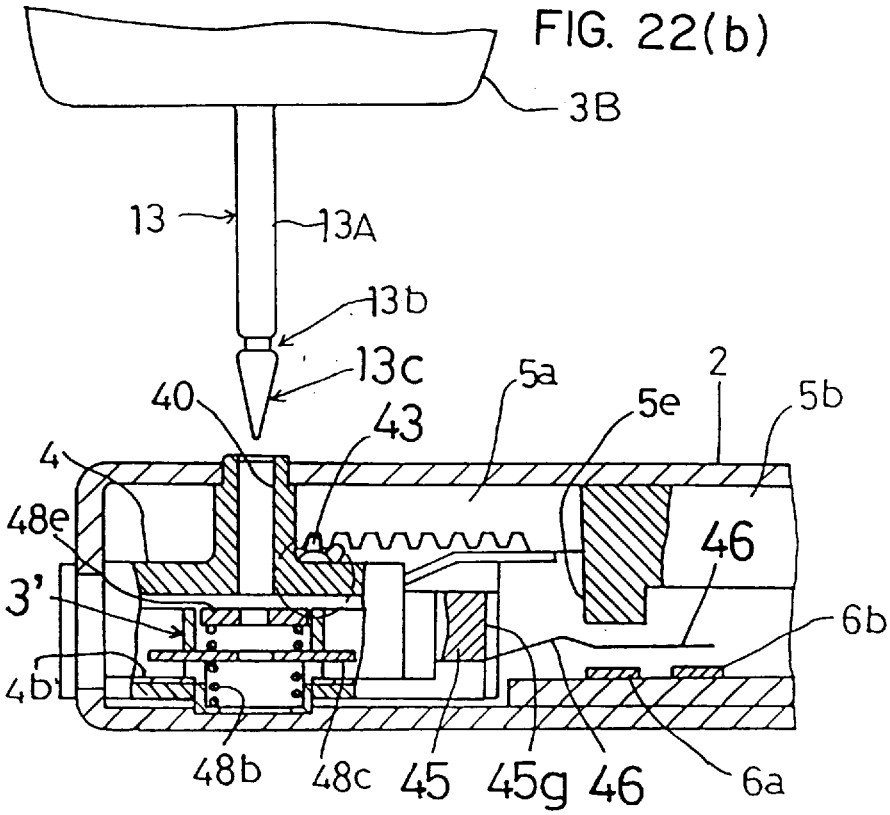
Figure 23A:
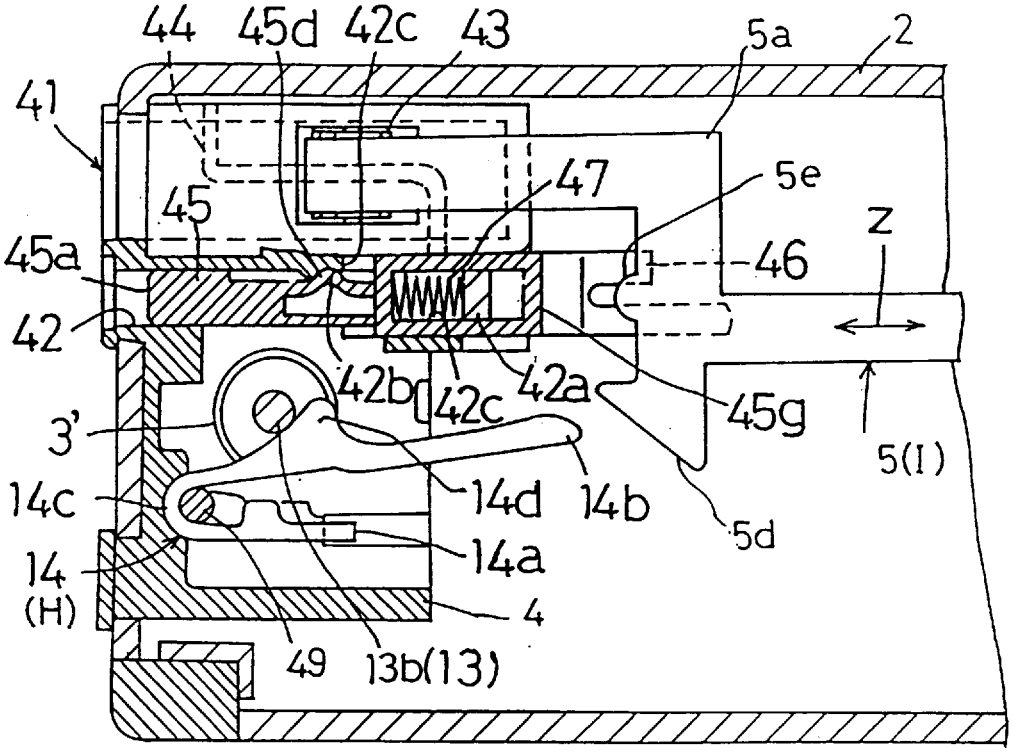
Figure 23B:
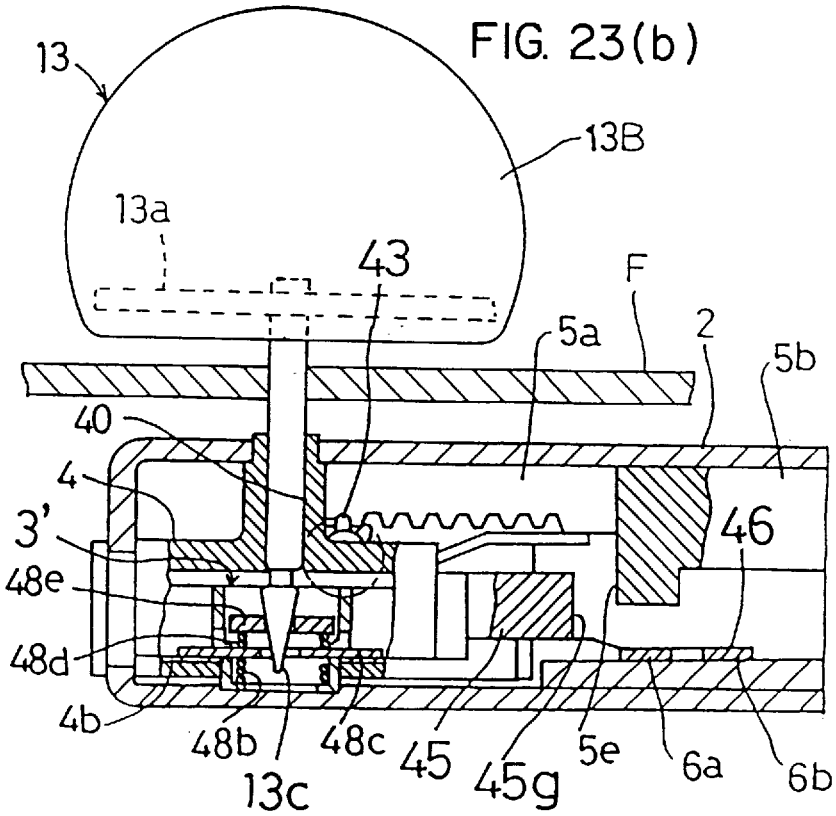

As shown in FIG. 22 (*b*) and FIG. 23 (*b*), the mounting pin 13 includes a shank 13A formed of metal, and a head 13B formed of plastic and holding one end thereof. A disk-shaped metal plate 13*c* is attached to the end of shank 13 held by the head 13B, which is covered by the head 13B and extends perpendicular to the axis of shank 13A. A tip end region of shank 13A defines an engaging groove 13*b* for engaging the box 2.

For attaching the box 2 to a commodity such as a garment, the mounting pin 13 is pierced through the cloth of garment F and connected to the box as shown in FIG. 23 (*b*).

Figure 20:
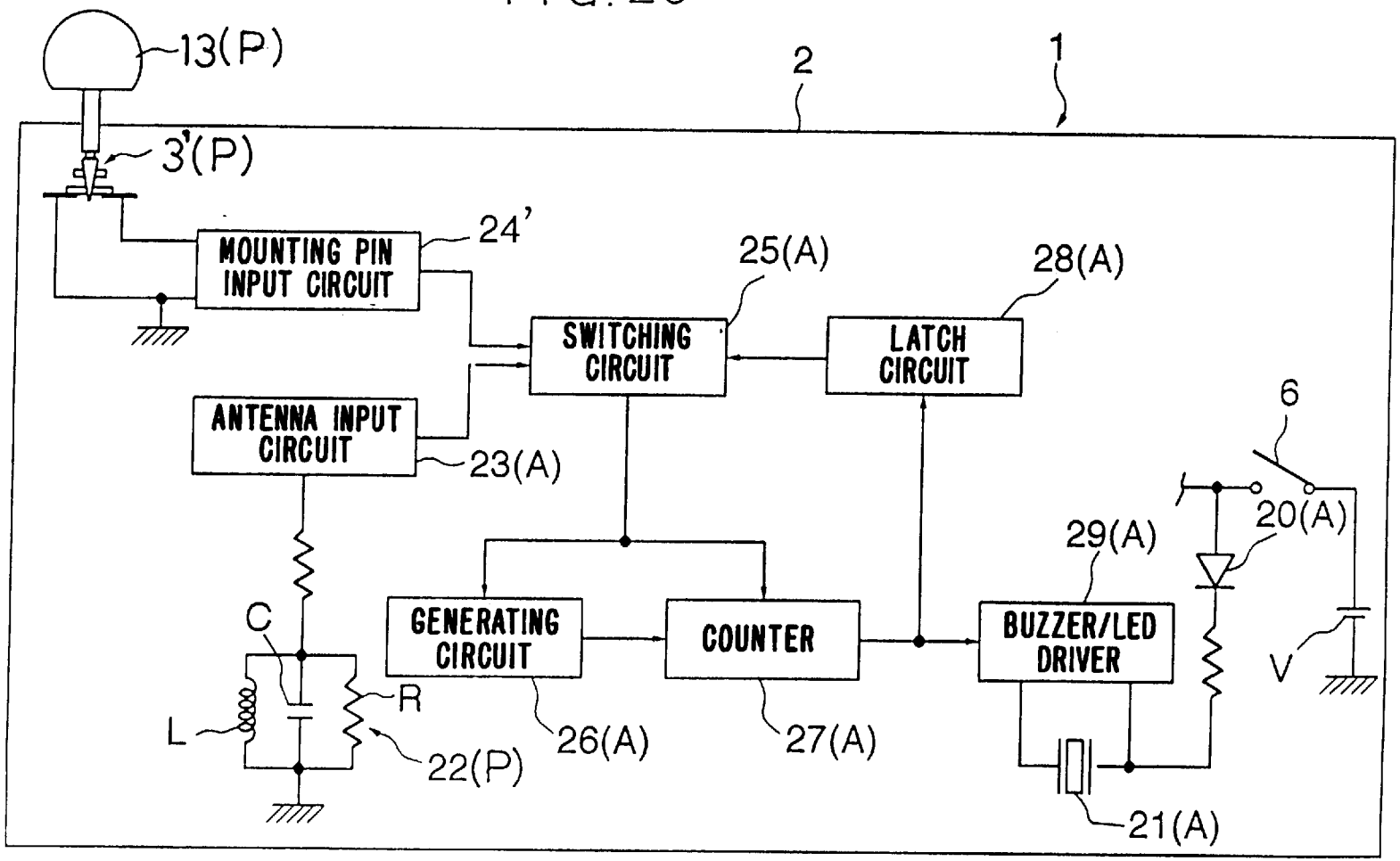
FIG. 20 is a schematic view of a different embodiment of the present invention, FIGS. 21 (*a*), (*b*) are views showing outward appearances of the embodiment of FIG. 20, FIGS. 22 (*a*), (*b*) are sectional views of the principal portion of the embodiment of FIG. 20, FIGS. 23 (*a*), (*b*) are sectional views of the principal portion of the embodiment of FIG. 20, FIGS. 24 (*a*), (*b*) are sectional views of the principal portion of the embodiment of FIG. 20.

As shown in FIG. 20, the box 2 of sensor tag 1 contains an LED lamp 20; a piezoelectric buzzer 21; a resonance antenna 22 including a coil L, a capacitor C and a resistor R; an antenna input circuit 23 for outputting a reception signal when the resonance antenna 22 is in signal receiving state; a detecting switch 3' turned on and off by insertion and removal of the mounting pin 13; a mounting pin input circuit 24' for outputting a mounting pin removal signal when the detecting switch 3' is turned off; a switching circuit 25 for outputting a control signal upon receipt of the reception signal from the antenna input circuit 23 or mounting pin removal signal from the mounting pin input circuit 24'; a generating circuit 26 which starts generating pulses upon input of the control signal from the switching circuit 25; a counter 27 which starts counting the pulses generated by the generating circuit 26 upon input of the control signal from the switching circuit 25, and outputs a count completion signal when the count exceeds a predetermined number; a latch circuit 28 responsive to input of the count completion signal to maintain switching circuit 25 in the state of receiving the above reception signal or wire cut signal; a buzzer/LED driver 29 for lighting the LED lamp 20 and sounding the piezoelectric buzzer 21 upon input of the mounting pin removal signal of counter 27; a battery V for supplying power to the respective circuits in the box 2; and a power supply switch 6 for turning on and off the power supply from the battery V to the circuits.

With the circuit having the above construction, the piezoelectric buzzer 21 mounted in the box 2 sounds when, with the power supply switch 6 turned on, the mounting pin 3 is pulled out, or the sensor tag 1 is passed through a position where a pair of panel-like transmitters O as shown in FIG. 19 are installed at opposite sides of an entrance of a shop. Thus, the mounting pin 13, detecting switch 3' and resonance antenna 22 act as a detecting device P for detecting a preliminary stealing act. The piezoelectric buzzer 21 and LED lamp 20 act as an alarm output device Q for outputting an alarm based on information from the detecting device P.

As in the preceding embodiment, one of the panel-like transmitters O may be installed at one side of the entrance, or on a floor of the entrance.

The resonance antenna 22 has its reception sensitivity adjusted beforehand according to an expected spacing with which the pair of transmitters O are installed.

The adjustment of reception sensitivity can be carried out in two ways.

The reception sensitivity of resonance antenna 22 increases linearly with an increase in the resistance value of resistor R. Accordingly, one of the two methods is carried out by appropriately changing the resistor R to one having a suitable resistance value. When the resistance value of the resistor is changed, Q value of the resonance antenna changes with the resistance value, and the reception sensitivity of the resonance antenna changes with it.

On the other hand, the resonance frequency of the resonance antenna does not change even if the resistance value of the resistor is changed. Thus, the change of reception sensitivity by a change of resonance frequency need be taken into account.

In adjusting the reception sensitivity of the resonance antenna, according to this method, it is unnecessary to consider a change in reception sensitivity due to a change in resonance frequency. The reception sensitivity of the resonance antenna can, therefore, be adjusted easily.

Figure 29:
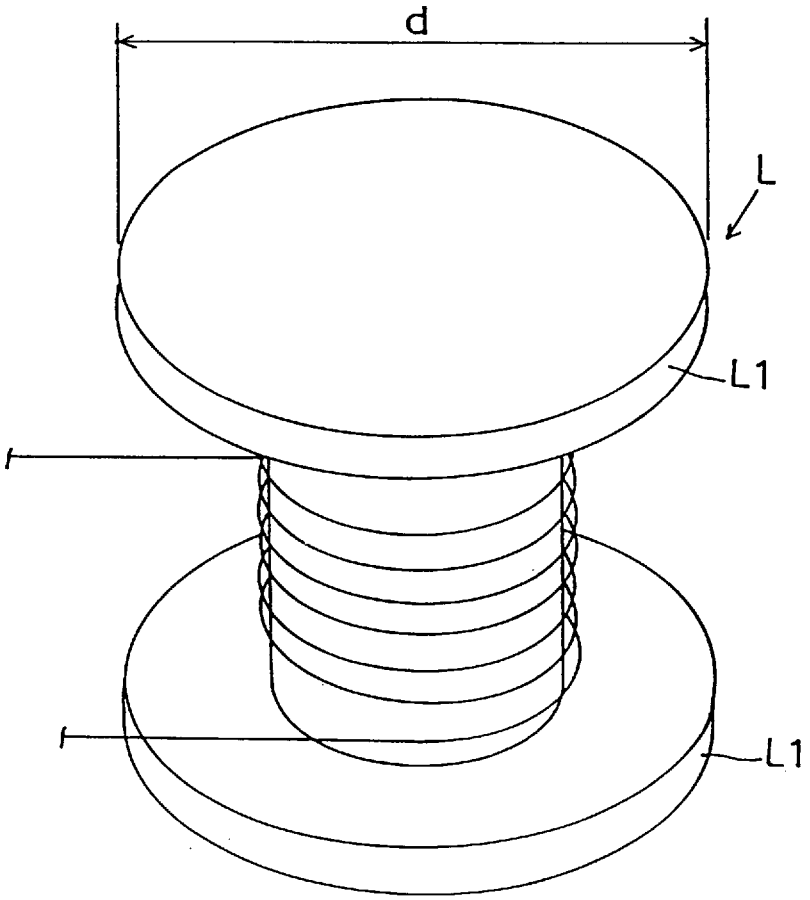
FIG. 29 is an enlarged view of a coil in the embodiment of FIG. 20.

The coil L has a drum type core L1 as shown in FIG. 29. The reception sensitivity of resonance antenna 22 increases linearly with an increase in flange diameter d of drum type core L1. The other method is carried out by using a core having a suitable flange diameter d. Even if flange diameter d is changed, the inductance of coil L should be maintained substantially fixed. When the flange diameter of the drum type core of the coil is varied, the convergence effect of magnetic flux by the coil changes, which in turn changes the reception sensitivity of the resonance antenna. On the other hand, the resonance frequency of the resonance antenna does not change with a change in the above flange diameter if the inductance value of the coil is fixed Accordingly, a change in reception sensitivity due to a change in resonance frequency need not be considered.

In adjusting the reception sensitivity of the resonance antenna, according to this method, a change in reception sensitivity due to a change in resonance frequency need not be considered. The reception sensitivity of the resonance antenna can be adjusted easily.

A process for causing the piezoelectric buzzer 21 to begin to sound when the theft preventive apparatus is handled improperly as noted above will be described briefly hereinafter.

First, when the mounting pin 13 is detached from the box 2 to change the detecting switch 3' from on state to off state, the mounting pin input circuit 24' outputs the mounting pin removal signal to the switching circuit 25.

While the mounting pin removal signal is inputted, the switching circuit 25 sends the control signal to the generating circuit 26 and counter 27. While the control signal is received, the generating circuit 26 generates pulses, and the counter 27 counts the pulses generated by the generating circuit 26. When the control signal stops, the generating circuit 26 stops generating pulses, and the counter 27 stops counting and resets a pulse count.

Each time a predetermined count of pulses is reached, the counter 27 sends one pulse signal as a count completion signal to the latch circuit 26 and buzzer/LED driver 29.

While this count completion signal is received, the buzzer/LED driver 29 sounds the piezoelectric buzzer 21, and lights the LED lamp 20.

On the other hand, the latch circuit 28 receives the count completion signal from the counter 27, and maintains the switching circuit 25 in the state of receiving the above OFF signal. The switching circuit 25 thereby continues sending the control signal to the generating circuit 26 and counter 27.

In other words, the buzzer/LED driver 29 sounds the piezoelectric buzzer 21 and lights the LED lamp 20 after the switching circuit 25 receives the mounting pin removal signal and the counter 27 completes counting up to the predetermined count. Thus, unless the OFF signal is continuously received over a fixed time, the piezoelectric buzzer 21 and LED lamp 20 remain out of operation. The prevents malfunctioning due to noise or the like.

The switching circuit 25 continues sending the control signal once the counter 27 outputs the count completion signal, regardless of presence or absence of the mounting pin removal signal from the mounting pin input circuit 24'. Consequently, until the power supply switch 6 is turned off, the piezoelectric buzzer 21 continues outputting intermittent sound synchronously with the count completion signal from the counter 27, and the LED lamp 20 continues flashing synchronously with the count completion signal from the counter 27.

When the sensor tag 1 passes through a position where the transmitters O are installed, the resonance antenna 22 generates an electromotive force with an electric wave from the transmitters O. The antenna input circuit 23 detects the electromotive force, and outputs the reception signal to the switching circuit 25.

The operation of each circuit after the switching circuit 25 receives the reception signal is the same as when the above-mentioned mounting pin 13 is detached, and will not be described again.

The antenna input circuit 23, switching circuit 25, generating circuit 26, counter 27, latch circuit 28, buzzer/LED driver 29, LED lamp 20 and piezoelectric buzzer 21 act as an alarm device A operable upon receipt of the signal from the resonance antenna 22.

A construction for attaching the mounting pin 13 to the box 2 will be described next.

Figure 24A:
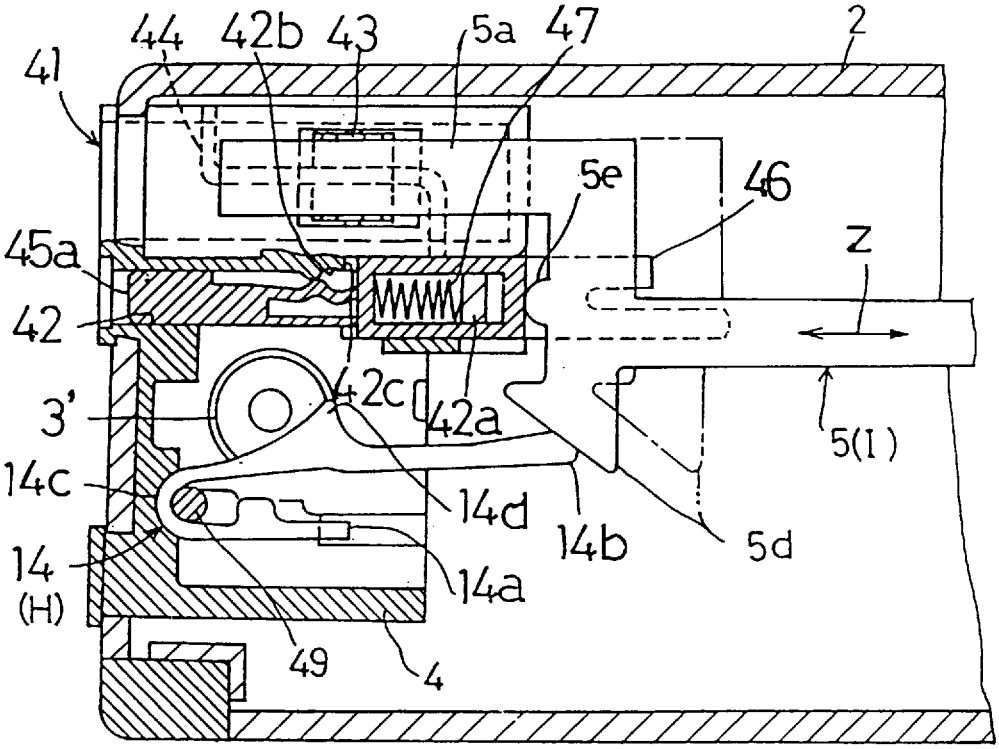
Figure 24B:
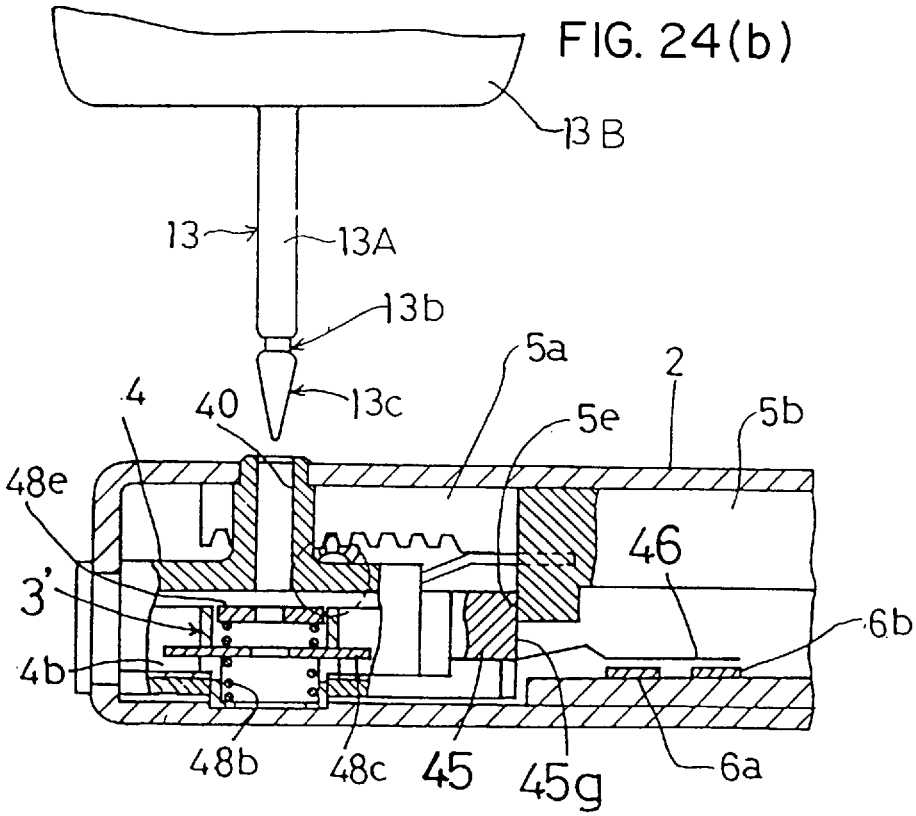

As shown in FIGS. 22–24, the mounting pin 13 is attached to the box 2, as inserted into a mounting pin insertion hole 40 of a jack unit 4 contacting an inner wall of box 2.

As shown in FIGS. 22–24, the jack unit 4 has a lock spring 14 in the form of a fishing hook for engaging and retaining the mounting pin 13 inserted into the pin insertion hole 40. The detecting switch 3' is provided at an end inwardly of lock spring 14 in the direction of insertion of the mounting pin 13.

The lock spring 14 is formed of metal, and has elasticity to move opposite ends 14*a*, 14*b* toward or away from each other. The lock spring 14 is engaged at a curved portion 14*c* thereof with an engaging projection 49 projecting from a main body of jack unit 4. The end 14*a* of lock spring 14 is fixed to the main body of jack unit 4.

A bulge 14*d* is formed in an intermediate position between the other end 14*b* and curved portion 14*c* of lock spring 14 to be projectable and retractable to engage the engaging groove 13*b* of mounting pin 13.

Figure 25:
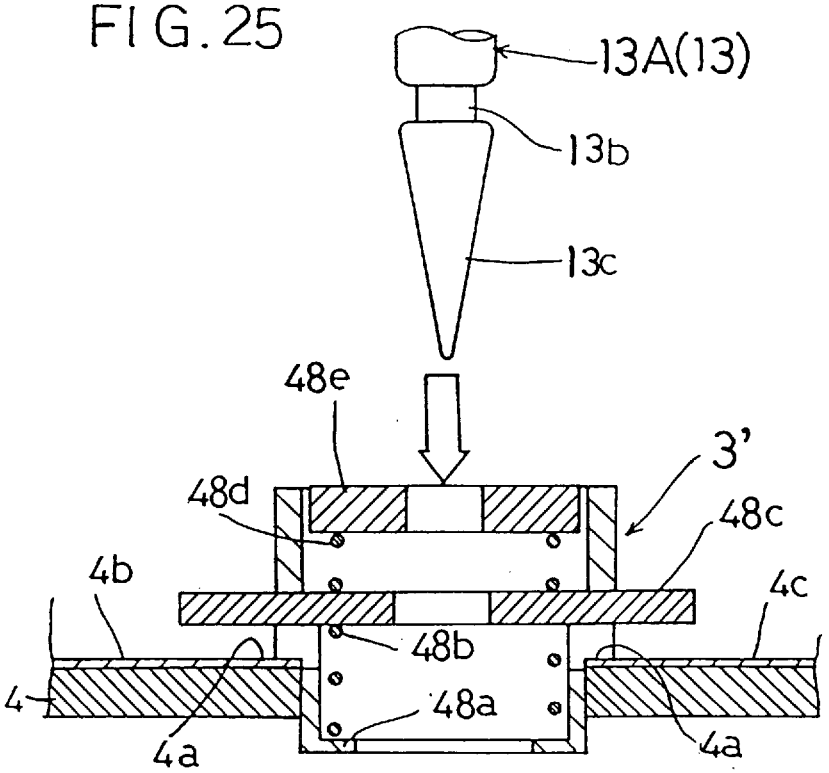
FIG. 25 is a sectional view of the principal portion of the embodiment of FIG. 20.

As shown in FIG. 25, the detecting switch 3' is in the form of two pipes of different diameters placed one over the other. A brim 48*a* is formed at a deep end thereof in the direction of insertion of mounting pin 13.

The detecting switch 3' contains a coil spring 48*b* having one end thereof fixed to an inward surface of the brim 48*a*, a metal plate 48*c* supporting the other end of coil spring 48*b*, a coil spring 48*d* having one end thereof fixed to the end of metal plate 48*c* opposite from the surface supporting the end of coil spring 48*b*, and a plastic plate 48*e* supporting the other end of coil spring 48*d*.

The metal plate 48*c* is cut out to define a circular opening centrally thereof to allow passage of a tapered portion 13*c* at the end of mounting pin 13. The plastic plate 48*e* is cut out to define a circular opening centrally thereof to support the tapered portion 13*c* at the end of mounting pin 13.

The metal plate 48*c* penetrates and projects from a side wall of detecting switch 3'. The side wall of detecting switch 3' is partly cut out to allow movement of the projecting portion in the direction of insertion of mounting pin 13.

Two divided electrode terminals 4*b*, 4*c* are formed on a mounting surface 4*a* of the main body of jack unit 4 supporting the detecting switch 3'. As shown in FIG. 20, these electrode terminals 4*b*, 4*c* are connected to the mounting pin input circuit 24' disposed in the box 2.

Adjacent the mounting pin insertion hole 40 is a set button pin insertion hole 42 extending through the jack unit 4 in a direction perpendicular to the direction of pin insertion of mounting pin insertion hole 40. The set button pin insertion hole 42 has a set button pin 45 slidably mounted in the set button pin insertion hole 42. A spring-like contact switch 46 formed of metal is mounted in an end opening of the set button pin insertion hole 42 inwardly of the box 2, with one end thereof fixed to the jack unit 4, to be pivotable when pushed by the set button pin 45.

Figures 28A, 28B:
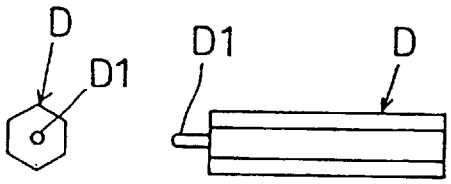

As shown in FIG. 11 (*a*) and FIG. 28 (*b*) which is a section taken on E—E of FIG. 11 (*a*), the set button pin 45 includes an operated portion 45*a* pushed from outside the box 2, a positioning portion 45*b* for positioning the set button pin 45, when pushed, in a particular location inside the set button pin insertion hole 42, and a spring storing portion 45*c* storing a coil spring 47 for biasing the set button pin 45 in a direction opposite to the inserting direction of the set button pin 45.

Figure 26:
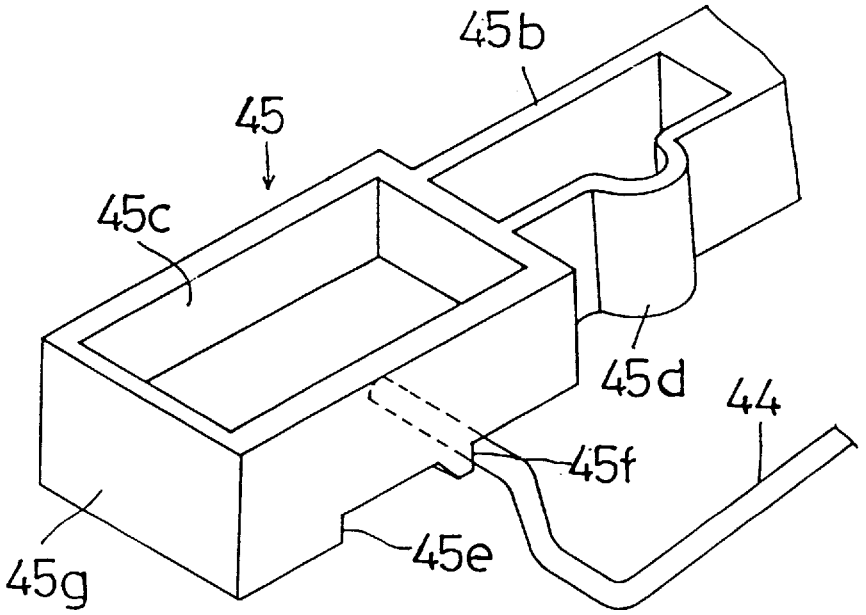
FIG. 26 is a perspective view of the principal portion of the embodiment of FIG. 20, FIGS. 27 (*a*), (*b*), (*c*) are enlarged views of a slider in the embodiment of FIG. 20, FIGS. 28 (*a*), (*b*) are enlarged views of a power source setting jig in the embodiment of FIG. 20.

As shown in FIG. 26, the spring storing portion 45*c* is in the form of a box having an open side. A projection 42*a* projects from an inner wall of set button pin insertion hole 42 into a space defined by this spring storing portion 45*c* and inner wall of set button pin insertion hole 42. Two engaging portion 45*e,* 45*f* are arranged, in sliding directions of set button pin 45, on a bottom of box-like spring storing portion 45*c* to engage a tip end portion of a movement check spring 44 described later.

The coil spring 47 is disposed between an inner wall, at an outward side of the box 2, of the spring storing portion 45*c* and the projection 42*a*. As noted hereinbefore, the set button pin 45 is biased in the direction opposite to the inserting direction thereof.

The positioning portion 45*b* of set button pin 45 has a positioning bulge 45*d* having elasticity to be movable in the projecting direction. An inner wall of the set button pin insertion hole 42 includes a recess 42*a* for engaging the positioning bulge 45*d* when the set button pin 45 is pushed inwardly of the box 2.

When the set button pin 45 is pushed inwardly of the box 2, the end of set button pin 45 inwardly of the box 2 contacts the contact spring 46 to swing the contact spring 46. With this swinging movement, a free end of contact spring 46 touches the circuit board. As a result, as shown in FIG. 23 (*b*), the two electrode terminals 6*a,* 6*b* on the circuit board are short-circuited. This causes power to be supplied from battery V each circuit in the box 2. This contact spring 46 and two electrode terminals 6*a,* 6*b* correspond to the power supply switch 6 in FIG. 20.

A key insertion hole 41 is formed in a position of set button pin insertion hole 42 remote from the pin insertion hole 40, for receiving a disengaging key K to release the mounting pin 13 as described later.

As shown in FIG. 12, the key insertion hole 41 has, mounted therein, a pinion gear 43 rotatable by the disengaging key K inserted into the key insertion hole 41, and the movement check spring 44 for checking movement of the set button pin 45 provided for the set button pin insertion hole 42.

The pinion gear 43 is rotatably supported in the main body of jack unit 4, with teeth thereof projecting perpendicular to the direction of insertion of disengaging key K, and partly projecting into the key insertion bore 41 and partly projecting outside the jack unit 4.

The movement check spring 44 is formed of a thin metal piece to be elastically deformable. The movement check spring 44 has one end thereof fixed to one side adjacent an opening of the key insertion hole 41 to be pivotable through elastic deformation. According to a position in the sliding direction of the set button pin 45, the free end of the movement check spring 44 is pressed by the elastic action of movement check spring 44, to engage one of the engaging portions 45*e,* 45*f* of set button pin 45. The biasing force of coil spring 47 prevents the set button pin 45 from sliding outwardly of the box 2. FIG. 26 shows a state of engagement with the engaging portion 45*f*.

An intermediate portion between the proximal end and free end of movement check spring 44 extends across the key insertion hole 41.

Figure 27A:
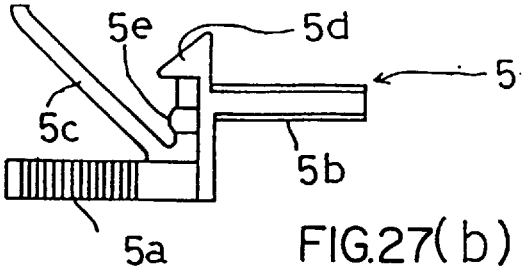
Figure 27B:
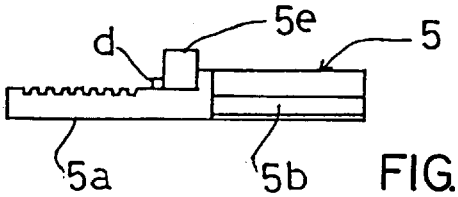
Figure 27C:
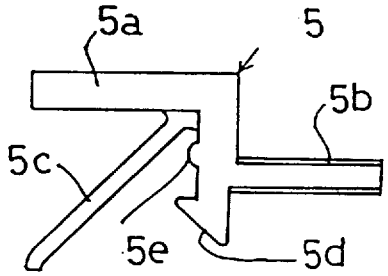

The jack unit 4 includes a slider 5 mounted in a position thereof inwardly of the box 2, as shown in FIGS. 27 (*a*) and 27 (*b*), having a rack 5*a* meshed with the portion of pinion gear 43 of jack unit 4 in the state shown in FIG. 12.

The slider 5 has a proximal portion 5*b* thereof slidably engaging a guide portion, not shown, formed on an inner wall of box 2, which is slidable in directions indicated by arrows z in FIGS. 22–24, i.e. in the directions of insertion and removal of the disengaging key K. A forward end of an elastically deformable extension 5*c* extending from an intermediate portion between rack 5*a* and proximal portion 5*b* engages the box 2, so that the elasticity of the extension 5*c* applies a biasing force inwardly of the box. For facility of illustration, the extension 5*c* is omitted from FIGS. 22–24.

Engagement and disengagement between the mounting pin 13 and box 2, and ON/OFF switching of power supply from the battery V to the circuits in the box 2, will be described next First, for engaging the mounting pin 13 and box 2, in the state where the mounting pin 13 is disengaged as shown in FIG. 22, the mounting pin 13 is pierced through the cloth of a garment F, as shown in FIG. 23, and inserted into the mounting pin insertion hole 40 of jack unit 4. As the mounting pin 13 is inserted against the biasing force of coil springs 48*b,* 48*d* provided for the mounting pin insertion hole 40, the bulge 41*d* of lock spring 14 projecting into the mounting pin insertion hole 40 engages the engaging groove 13*b* of mounting pin 13. The biasing force of coil springs 48*b,* 48*d* prevents the mounting pin 13 from moving in the direction of cancellation, to maintain the engaged state.

In the course of insertion prior to engagement between the engaging groove 13*b* of mounting pin 13 and the bulge 14*d* of lock spring 14, the tapered portion 13*c* at the end of mounting pin 13 contacts the plastic plate 48*e* of jack unit 4. As the mounting pin 13 is further inserted against the biasing force of coil springs 48*b,* 48*d,* the metal plate 48*c* moves inwardly of the box 2 to contact the two electrode terminals 4*b,* 4*c* formed on the mounting surface 4*a* of detecting switch 3', thereby causing a short circuit therebetween. In this state, the detecting switch 3' shown in FIG. 20 changes from off state to on state.

At the point of time when the metal plate 48*c* causes a short circuit of the two divided electrode terminals 4*b,* 4*c,* the coil spring 148*d* still has an allowance for contraction. As the mounting pin 13 is inserted further, the mounting pin 13 and lock spring 14 engage each other.

This completes attachment of sensor tag 1 to the commodity. Next, the sensor tag 1 is set in operation.

Operation of sensor tag 1 is started by using a power supply setting jig D as shown in FIG. 28 (*a*), (*b*).

The operated portion 45*a* of set button pin 45 of jack unit 4 is pushed inward with a projecting pin D1 of power supply setting jig D. Then, the end 45*g* of set button pin 45 inwardly of box 2 contacts the contact spring 46, to pivot the contact spring 46. With this pivotal movement, the free end of contact spring 46 touches the circuit board to cause a short circuit of two electrode terminals 6*a,* 6*b* on the circuit board. This starts the power supply from battery V to each circuit in the box 2. A positioning shoulder 42*c* is formed on an inner wall of the set button pin insertion hole 42 for contacting the spring storing portion 45*c* of set button pin 45 so that, in the state that the set button pin 45 is not pushed in, the operated portion 45*a,* which is an outer end of box 2 outside edge, of set button pin 45 is slightly indented from the opening of set button pin insertion hole 42 outwardly of the box 2.

When this set button pin 45 is pushed, the free end of movement check spring 44 engaged with the engaging portion 45*e* of set button pin 45 switches to a position to engage the engaging portion 45*f* of set button pin 45 as shown in FIG. 26.

In the position where the set button pin 45 causes the free end of contact spring 46 to pivot toward the circuit board, the coil spring 47 is compressed to push the set button pin 45 outwardly of the box 2. However, a sliding movement of set button pin 45 is prevented by the engagement between the free end of movement check spring 44 and the engaging portion 45*f* of set button pin 45 as noted above. A sliding movement of set button pin 45 is prevented also by the engagement between the positioning bulge 45*d* of set button pin 45 and the engaging recess 42*b* of set button pin insertion hole 42.

Figure 18:
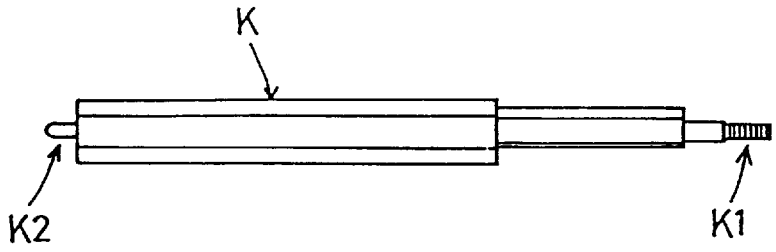
FIG. 18 is a view of an outward appearance of a disengaging key in the embodiment of FIG. 1.

Next, the disengaging key K shown in FIG. 18 is used for disengaging the mounting pin 13 and jack unit 4 in the state shown in FIG. 23.

The disengaging key K has a rack portion K1 for engaging the pinion gear 43 of jack unit 4. In the state shown in FIG. 23, when the rack portion K1 is inserted into the key insertion hole 41, the rack portion K1 and pinion gear 43 mesh with each other, whereby the pinion gear 43 rotates with the insertion of the rack portion K1. With the rotation of this pinion gear 43, the slider 5 having the rack portion 5*a* meshed with the pinion gear 43 moves from the position shown in a dot-and-dash line to the position shown in a solid line in FIG. 24. When the rack portion K1 of disengaging key K is inserted into the key insertion hole 41, the movement check spring 44 extending across the key insertion hole 41 is pressed whereby the movement check spring 44 is pressed against a wall of the key insertion hole 41. This causes the free end of movement check spring 44 to pivot, thereby disengaging the free end from the engaging portion 45*f* of set button pin 45.

The slider 5 has a first presser portion 5*d* for contacting the end 14*b* of lock spring 14, and a second presser portion 5*e* for contacting the end of the set button pin 45 inwardly of the box 2, with the sliding movement of slider 5. When the first presser portion 5*d* pushes the end 14*b* of lock spring 14, as shown in FIG. 24, the bulge 14*d* of lock spring 14 pivots out of the mounting pin insertion hole 40. This disengages the engaging groove 13*b* of mounting pin 13 and the bulge 14*d* of lock spring 14. The mounting pin 13 is pushed out of the box 2 under the biasing force of coil springs 48*b*, 48*d* of detecting switch 3'.

On the other hand, when the second presser portion 5*e* pushes the end of set button pin 45 inwardly of the box 2, the set button pin 45 moves outwardly of the box 2. This disengages the positioning bulge 45*d* of set button pin 45 and the engaging recess 42*a* of set button insertion hole 42.

As a result, the set button pin 45 returns to the state prior to the depression of operated portion 45*a*, under the biasing force of coil spring 47 in the spring storing portion 45*c*. The contact spring 46 moves away from the two terminals on the circuit board, to stop the power supply from the battery V to the circuits in the box 2.

The timing of this power supply stoppage is slightly delayed from the timing of disengagement between the engaging groove 13*b* of mounting pin 13 and the bulge 14*d* of lock spring 14 The piezoelectric buzzer 21 sounds for an instant when the disengaging key K is operated to withdraw the mounting pin 13 from the pin insertion hole 40. The battery V may be checked simultaneously with this withdrawal operation.

(6) In the above embodiment, the alarm device A receives a signal from the resonance antenna 22, and sounds the piezoelectric buzzer 21 and light LED lamp to give an alarm. However, an electric wave signal my be transmitted upon receipt of the signal from the resonance antenna 22, with a separate device provided to receive the electric wave signal and give an alarm sound or the like.

(7) In the above embodiment, when adjusting the reception sensitivity of resonance antenna 22 by varying the resistance value of resistor R, the adjustment is made by replacing the resistor R with an appropriate one. However, a variable resistor may be used as resistor R, the reception sensitivity of the resonance antenna being adjusted by adjusting the resistance value of the variable resistor.

(8) The above embodiment exemplifies a theft preventive apparatus of the type that the box 2 of of the theft preventive apparatus is attached to an object of theft prevention through mounting pin 13. The present invention is applicable also to a theft preventive apparatus of the type that the attachment is made by means of a wire attachable and detachable at opposite ends thereof to/from the box 2.

According to this theft preventive apparatus, as shown in the plan view of FIG. 31 (*a*) and the side view of FIG. 31 (*b*), a sensor tag 1 includes a rectangular parallelopiped box 2 and a wire unit 103 acting as a an attaching device for attaching the box 2 to an object of theft prevention such as a commodity or the like.

Figures 31A, 31B, 32:
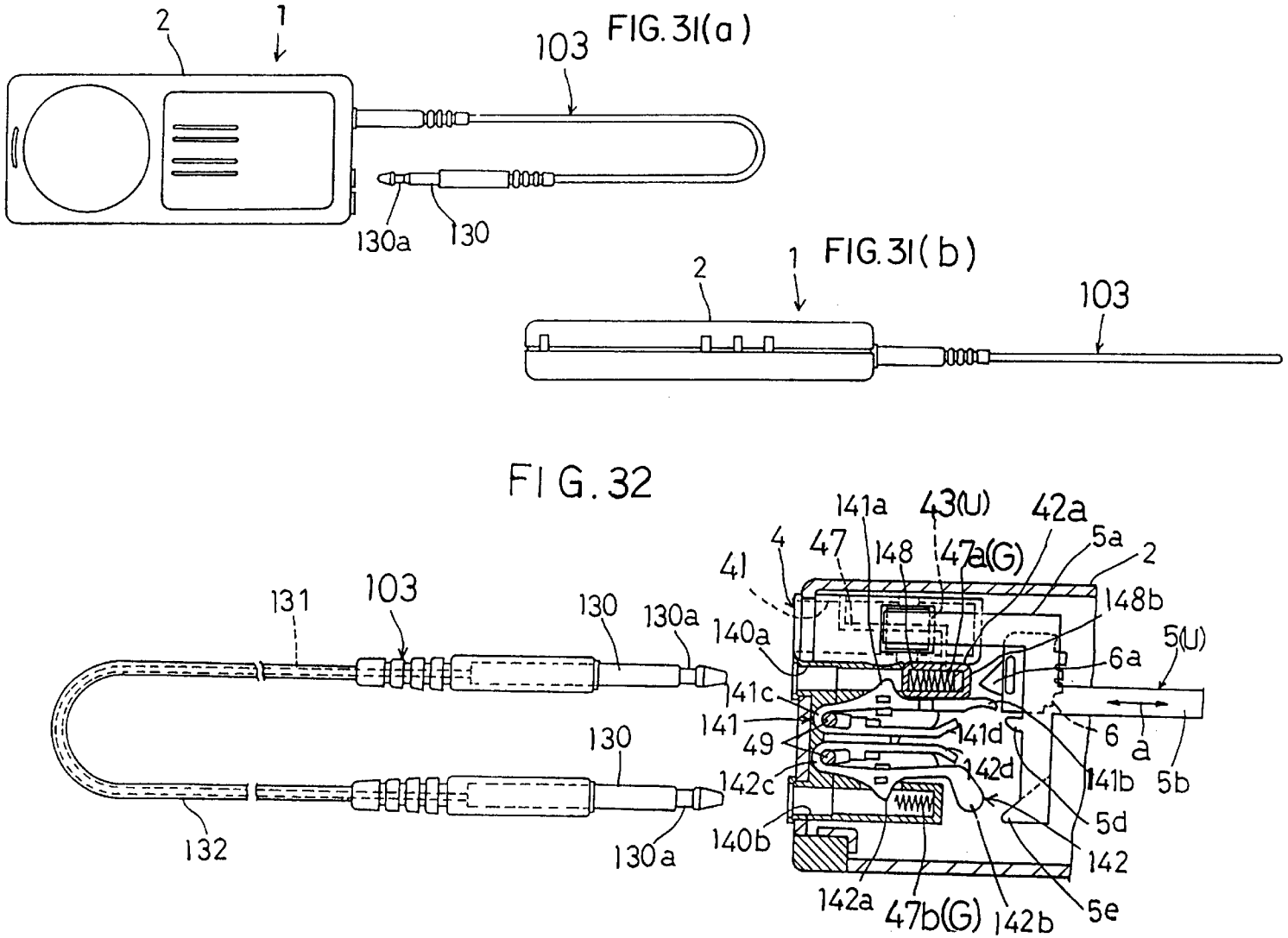
FIG. 32 is a sectional view of the principal portion of the embodiment of FIG. 30.

As shown in FIG. 32, the wire unit 103 has lock pins 130 disposed at opposite ends for connection to the box 2, a wire 131 interconnecting the lock pins 130, and a sheath 132 covering the wire 131 and parts of lock pins 30.

The lock pins 130 and wire 131 are formed of metal, and are conductive. The lock pins 130 at the opposite ends are electrically interconnected. The lock pins 130 have engaging grooves 130*a* formed adjacent tip ends thereof for retaining the lock pins 130 in the box 2.

Figure 34:
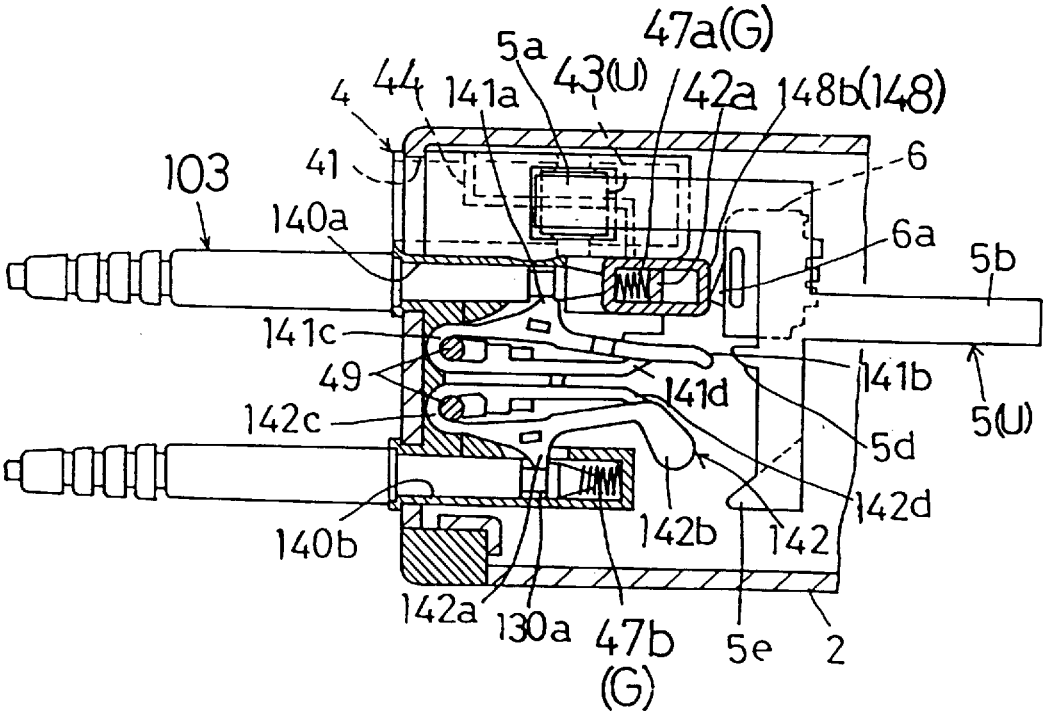
FIG. 34 is a sectional view of the principal portion of the embodiment of FIG. 30.

As shown in FIG. 32, slight shoulders are formed at ends of the sheath 132 covering the lock pins 130. When lock pins 130 are inserted into the box 2, the shoulders extend into the box 2, as shown in FIG. 34, so that the lock pins 130 are not exposed to the outside. This prevents the lock pins 130 from contacting other objects charged with static electricity, which would damage electric circuits in the box 2.

Figure 30:
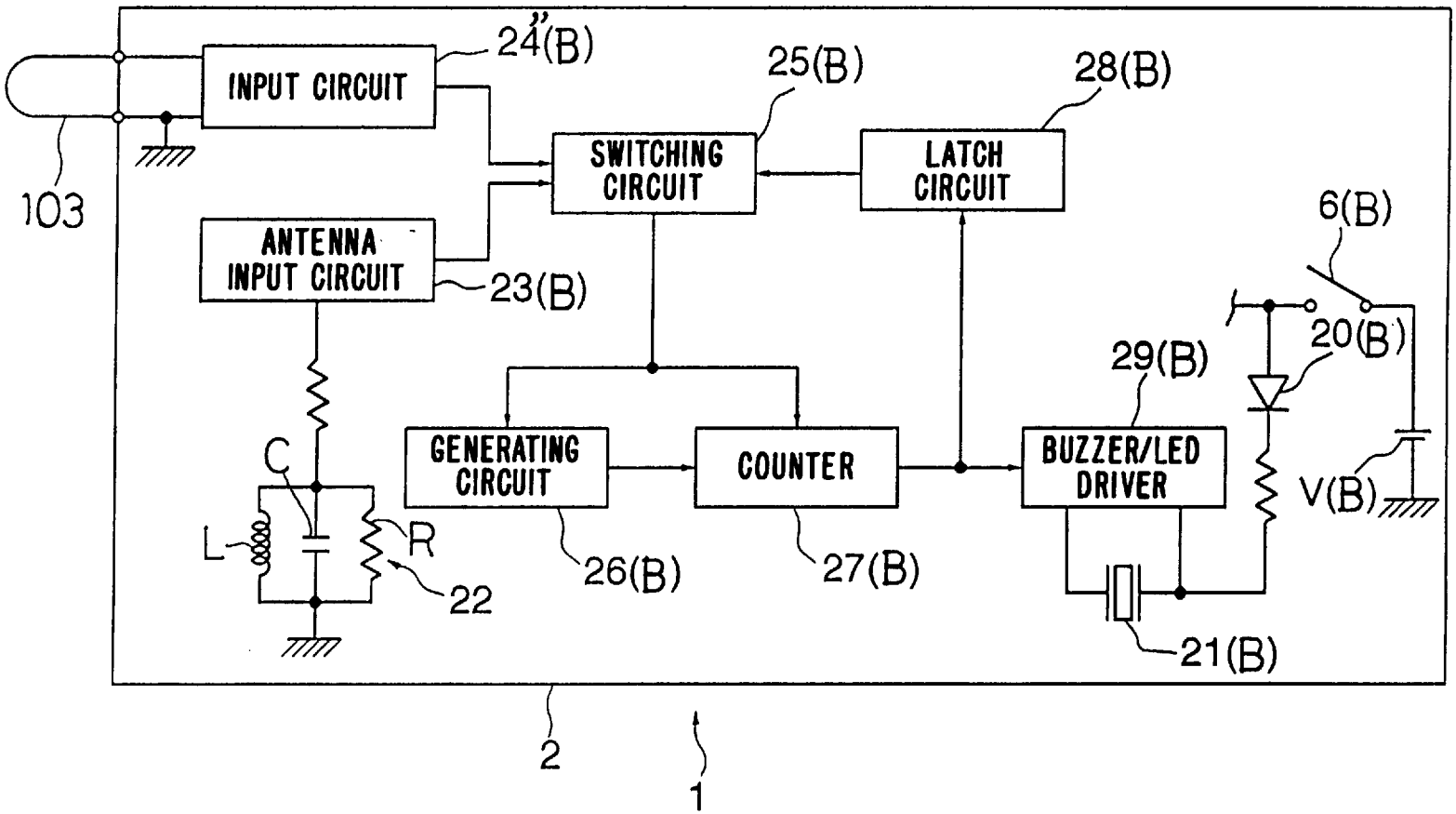
FIG. 30 is a schematic view of a different embodiment of the present invention, FIGS. 31 (*a*), (*b*) are views showing outward appearances of the embodiment of FIG. 30.

The circuitry shown in FIG. 30 is similar to the circuitries of FIG. 1 and FIG. 2. The differences are that the lock pins 130 forming parts of the wire unit 103 are inserted into insertion holes in place of the switch or mounting pin, and that a wire unit input circuit 24" is used in place of the switch input circuit or mounting pin input circuit. The piezoelectric buzzer 21 mounted in the box 2 sounds and the LED lamp 20 emits light when, with the power supply switch 6 turned on, the wire unit 103 is cut, or the sensor tag 1 is passed through a position where a pair of panel-like transmitters O as shown in FIG. 19 are installed at opposite sides of an entrance of a shop. Thus, the wire unit 103 and the reception device 22 mounted in the box 2 act as a detecting device P for detecting a preliminary stealing act. The LED lamp 20 and piezoelectric buzzer 21 act as an alarm output device Q for outputting an alarm based on information from the detecting device P.

The other operations are the same as the preceding embodiments, and the process for causing the piezoelectric buzzer to begin to sound will not be described here.

A construction for attaching the wire unit 103 to the box 2 will be described next.

As shown in FIGS. 32–36, the wire unit 103 is attached to the box 2, with the lock pins 130 of wire unit 103 inserted into two lock pin insertion holes 140*a*, 140*b* of a jack unit 4 contacting an inner wall of box 2.

The jack unit 4 has, arranged in juxtaposition, an approximately U-shaped lock spring 141 acting as an engaging member for engaging and retaining the lock pin 130 inserted into the lock pin insertion hole 140*a,* and an approximately U-shaped lock spring 142 acting as an engaging member for engaging and retaining the lock pin 130 inserted into the lock pin insertion hole 140*b*. At an end inwardly of the box 2 of the lock pin insertion hole 140*a* extending through the jack unit 4, a set lever 148 is provided to be slidable in the lock pin insertion hole 140*a* in directions of insertion and removal of lock pin 130.

The lock springs 141, 142 are engaged at curved portions 141*c,* 142*c* thereof with engaging projections 49 projecting from a main body of jack unit 4. Ends 141*d,* 142*d* of lock springs 141, 142 lying adjacent each other in inward positions are fixed to the circuit board rigidly supporting the circuits shown in FIG. 30.

Bulges 141*a,* 142*a* are formed in intermediate positions between the other ends 141*b,* 142*b* and curved portions 141*c,* 142*c* of lock springs 141, 142 to be projectable and retractable to engage the engaging grooves 130*a* of lock pins 130.

The lock springs 141, 142 are formed of metal and are conductive for electrically connecting the lock pins 130 to the above-mentioned circuit board.

Lock springs 141, 142 are approximately U-shaped, and, therefore, have elasticity in directions to move the opposite ends thereof toward and away from each other. When no force is applied to the lock springs 141, 142, as shown in FIG. 32, the bulges 141*a,* 142*a* of lock project almost to the central positions in the pin insertion holes 140*a,* 140*b*.

Thus, when the engaging grooves 130*a* of lock pins 130 and the bulges 141*a*, 412*a* engage each other, the bulges 141*a,* 142*a* are pushed in the direction to retract from the lock pin insertion holes 140*a,* 140*b,* whereby the lock springs 141, 142 are biased toward engagement with the lock pins 130.

Figure 37:
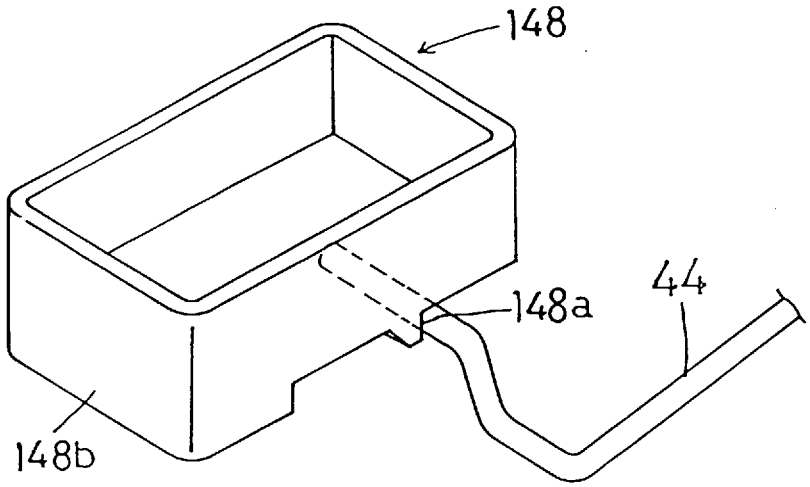
FIG. 37 is a perspective view of a principal portion of a set lever in the embodiment of FIG. 30.

As shown in FIG. 37, the set lever 148 is in the form of a box having an open side. A projection 42*a* projects from an inner wall of lock pin insertion hole 140*a* into a space defined by this set lever 148 and inner wall of lock pin insertion hole 140*a*.

A coil spring 47*a* is mounted between the projection 42*a* and inner wall of set lever 148, to bias the set lever 148 back toward an inlet of lock pin insertion hole 140*a*.

The other lock pin insertion hole 140*b* is closed at a deep end thereof. A coil spring 47*b* is mounted in the lock pin insertion hole 140*b,* with one end thereof fixed to the deep end.

A key insertion hole 41 is formed in a position of lock pin insertion hole 140*a* remote from the lock pin insertion hole 140*b,* for receiving a disengaging key K to release the lock pin 130 as described later.

Figure 38:
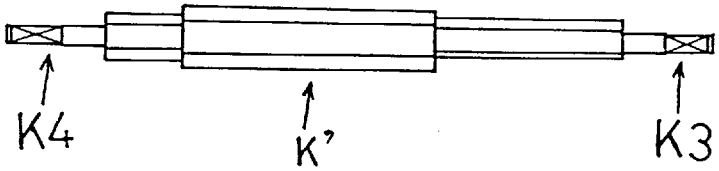
FIG. 38 is a view of an outward appearance of a disengaging key in the embodiment of FIG. 30, FIGS. 38 (*a*), (*b*) are enlarged views of a slider in the embodiment of FIG. 30.

As shown in FIG. 12, the key insertion hole 41 has, mounted therein, a pinion gear 43 rotatable by the disengaging key K' shown in FIG. 38, inserted into the key insertion hole 41, and the movement check spring 44 for checking movement of the set lever 148 provided for the lock pin insertion hole 140*a*.

The pinion gear 43 is rotatably supported in the main body of jack unit 4, with teeth thereof projecting perpendicular to the direction of insertion of the lock release key, and partly projecting into the key insertion hole 41 and partly projecting outside the jack unit 4.

The pinion gear 43 is supported to be slightly movable in directions perpendicular to the sheet plane of FIGS. 32–36. When the disengaging key K' is absent from the key insertion hole 45, the pinion lies inwardly of the key insertion hole 41 to be out of mesh with the rack 5*a* of slider 5.

The movement check spring 44 is formed of a thin metal piece to be elastically deformable. One end thereof is fixed to one side adjacent an opening of the key insertion hole 41 to act as a proximal end, to be pivotable through elastic deformation. The free end of movement check spring 44 is pressed by the elastic action of movement check spring 44, to engage an engaging portion 148*a* formed on an outer surface of set lever 148 as shown in FIG. 37.

An intermediate portion between the proximal end and free end of movement check spring 44 extends across the key insertion hole 41.

Figure 39:
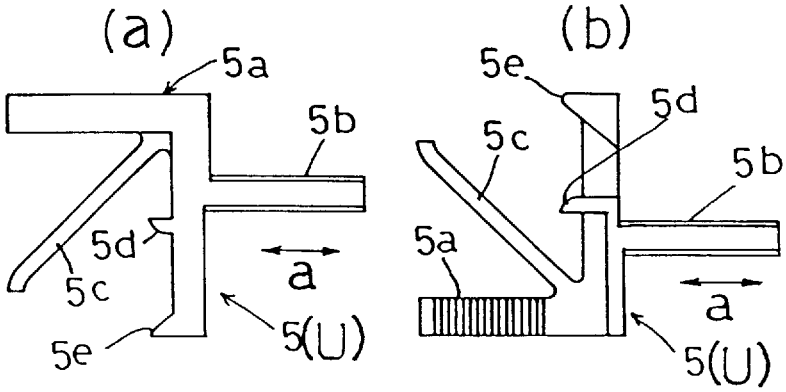

The jack unit 4 includes a slider 5 mounted in a position thereof inwardly of the box 2, which, as shown in FIGS. 12 (*a*) and 12 (*b*), has a rack 5*a* meshed with the pinion gear 43 of jack unit 4 in the position shown in FIG. 39 (*a*) and FIG. 39 (*b*).

The slider 5 has a proximal portion 5*b* thereof slidably engaging a guide portion, not shown, formed on an inner wall of box 2, which is slidable in directions indicated by arrows a in Fig, 32, i.e. in the directions of insertion and removal of the disengaging key K'. A forward end of an elastically deformable extension 5*c* extending from an intermediate portion between rack 5*a* and proximal portion 5*b* engages the box 2, so that the elasticity of the extension 5*c* applies a biasing force inwardly of the box. For facility of illustration, the extension 5*c* of slider 5 is omitted from FIGS. 32–36.

The power supply switch 6 is disposed in a position of the lock pin insertion hole 140*a* of jack unit 4 inwardly of the box 2.

The power supply switch 6 is a normally off type switch. Switching is made from off state to on state when an operated portion 6*a* of power supply switch 6 is pushed by the set lever 148 of jack unit 4.

Engagement and disengagement between the wire unit 103 and box 2 will be described next.

Figure 33:
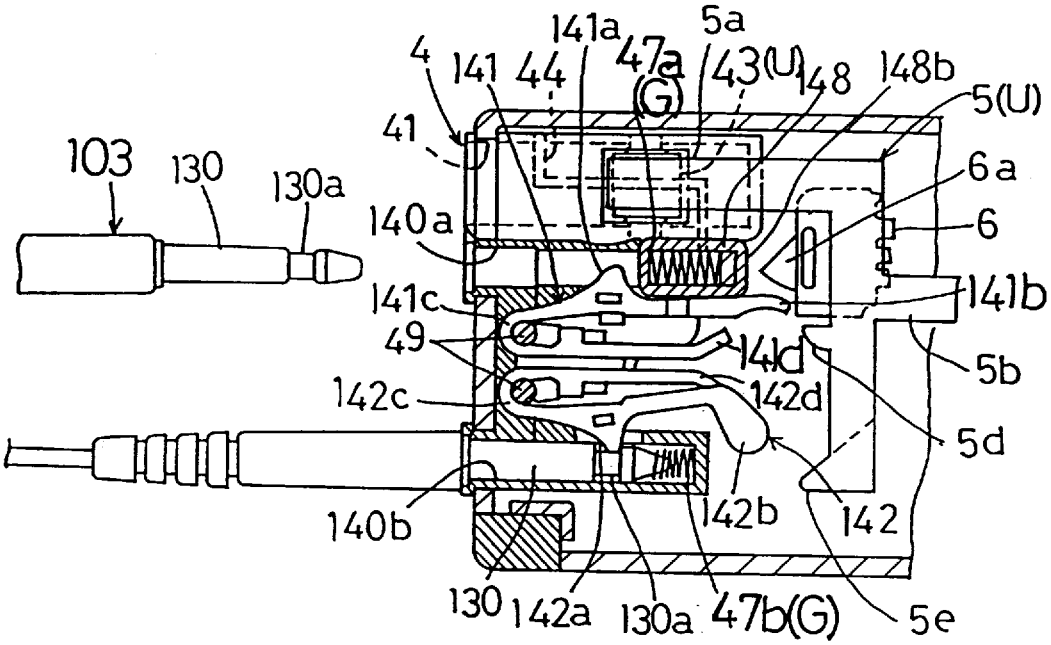
FIG. 33 is a sectional view of the principal portion of the embodiment of FIG. 30.

First, for engaging the wire unit 103 and box 2, in the state where both lock pins 130 of wire unit 103 are disengaged as shown in FIG. 32, one of the lock pins 130 is inserted into the lock pin insertion hole 140*b* of jack unit 4 as shown in FIG. 33. As the lock pin 130 is inserted against the biasing force of coil spring 47*b* provided for the lock pin insertion hole 140*b,* the bulge 142*a* of lock spring 142 projecting into the lock pin insertion hole 140*b* engages the engaging groove 130*a* of lock pin 130. The biasing force of coil spring 47*b* reliably prevents the lock pin 130 from moving in the direction of cancellation, to maintain the engaged state.

With one of the lock pins 130 inserted into the jack unit 4, the other lock pin 130 is placed in engagement with a commodity, and then inserted into the lock pin insertion hole 140*a* of jack unit 4.

As the lock pin 130 is inserted into the lock pin insertion hole 140*a,* the forward end of lock pin 130 contacts the set lever 148. As the lock pin 130 is further inserted while pushing the set lever 148, the bulge 141*a* of lock spring 141 projecting into in the lock pin insertion hole 140*a* engages the engaging groove 130*a* of lock pin 130 as shown in FIG. 34. At this time, the engaging portion 148*a* of set lever 148 has moved to a position of the movement check spring 44 extending from the key insertion hole 41. As shown in FIG. 37, the free end of movement check spring 44 engages the engaging portion 148*a*.

As a result of the pushing action of lock pin 130 applied to the set lever 148, the end of set lever 148 inwardly of the box 2 pushes the operated portion 6*a* of power supply switch 6 to start power supply to each circuit in the box 2 shown in FIG. 30.

In this state, the coil spring 47*a* mounted in the set lever 148 applies a biasing force to the lock pin 130 in the direction to disengage the lock pin 130. However, the lock pin 130 is prevented from moving in the disengaging direction by the engagement between the engaging groove 130*a* of lock pin 130 and the bulge 141*a* of lock spring 141 and by the engagement between the free end of movement check spring 44 and the engaging portion 148*a* of set lever 148.

As noted above, the wire unit 103 and the wire unit input circuit 24" in the box 2 are electrically interconnected through the engagement between the engaging grooves 130*a* of lock pins 130 and the bulges 141*a,* 142*a* of lock springs 141, 142.

Next, the disengaging key K shown in FIG. 38 is used for disengaging the wire unit 103 and jack unit 4 in the state shown in FIG. 34. The disengaging key K has a first rack portion K3 and a second rack portion K4 at opposite ends thereof for meshing with the pinion gear 43 of jack unit 4.

These two rack portions K3, K4 are different in insertion depth for the key insertion hole 41 of jack unit 4. The lengths are set such that the insertion depth of the second rack portion K4 is slightly greater than the insertion depth of the first rack portion K3. Consequently, the pinion gear 43 is rotatable by different amounts when the first rack portion K3 is inserted into the key insertion hole 41 and when the second rack portion K4 is inserted into the key insertion hole 41.

As shown in FIG. 12, when the first rack portion K3 of the smaller insertion depth is inserted into the key insertion hole 41, the first rack portion K3 lifts the pinion gear 43 into mesh with the rack portion 5*a* of slider 5. The first rack portion K3 and pinion gear 43 are also meshed with each other. The pinion gear 43 rotates with the insertion of the first rack portion K3. With this rotation of pinion gear 43, the slider 5 having the rack portion 5*a* meshed with the pinion gear 43 moves in the direction of arrow b in FIGS. 35 and 12. When the first rack portion K3 of disengaging key K' is inserted into the key insertion hole 41, the movement check spring 44 extending across the key insertion hole 41 is pressed, whereby the movement check spring 44 is pressed against a wall of the key insertion hole 41. As a result, the free end of movement check spring 44 swings to disengage from the engaging portion 148*a* of set lever 148. FIG. 12 shows the pinion gear 43 in the position lifted by the first rack portion K3.

Figure 35:
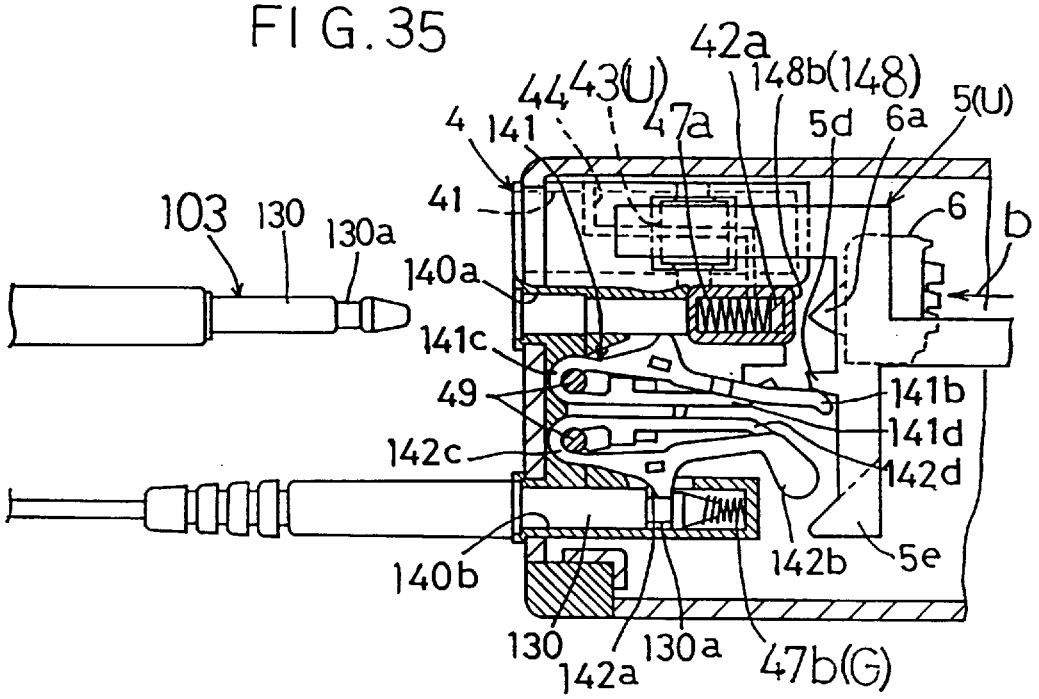
FIG. 35 is a sectional view of the principal portion of the embodiment of FIG. 30.

The slider 5 has a first presser portion 5*d* which, with a sliding movement of the slider 5 in the direction of arrow b, contacts the end 141*b* of lock spring 141. When the first presser portion 5*d* pushes the end 141*b* of lock spring 141, as shown in FIG. 35, the bulge 141*a* of lock spring 141 retracts from the lock pin insertion hole 140*a*. Thus, the engaging groove 130*a* of lock pin 130 and the bulge 141*a* of lock spring 141 become disengaged.

As a result, the lock pin 130 inserted in the lock pin insertion hole 40*a* is pushed out under the biasing force of coil spring 47*a* inserted in the set lever 148, to change the power supply switch 6 from on state to off state. This stops the power supply to each circuit in the box 2.

The timing of this power supply switch 6 changing from on state to off state is slightly delayed from the timing of disengagement between the engaging groove 130*a* of lock pin 130 and the bulge 141*a* of lock spring 141. The piezoelectric buzzer 21 sounds for an instant when the disengaging key K' is operated to withdraw the lock pin 130 from the lock pin insertion hole 140*a*. The battery V may be checked simultaneously with this withdrawal operation.

After the lock pin 130 is withdrawn from the lock pin insertion hole 140*a*, the lock pin 130 inserted in the lock pin insertion hole 140*b* may also be withdrawn to change the wire unit 103. In this case, the second rack portion K4 of disengaging key K' is inserted into the key insertion hole 41.

Figure 36:
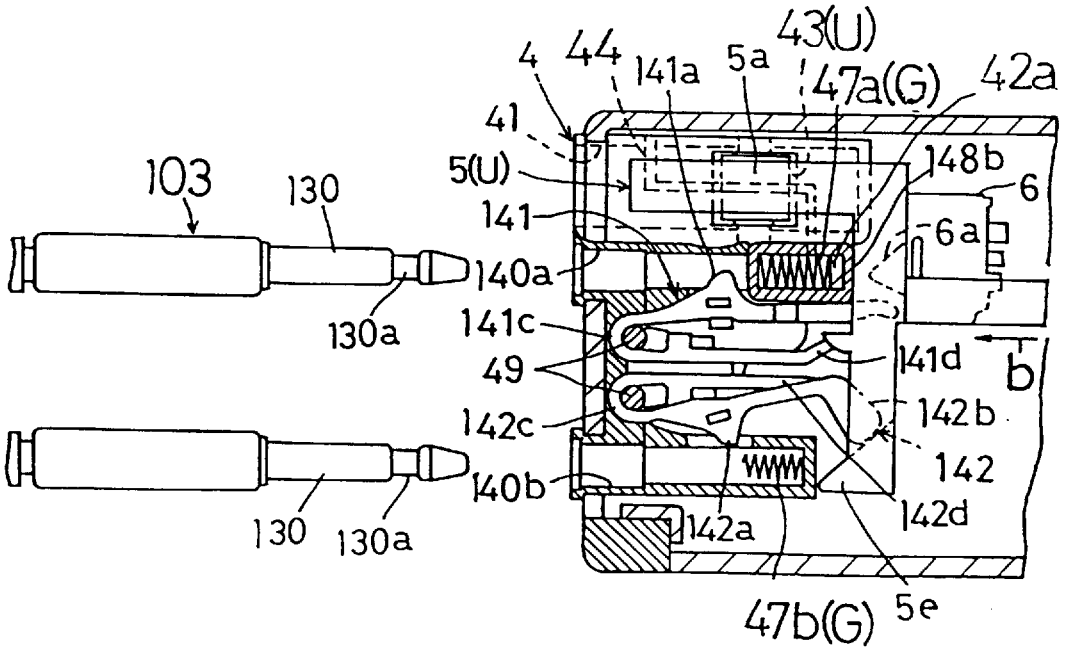
FIG. 36 is a perspective view of the principal portion of the embodiment of FIG. 30.

The second rack portion K4 has a greater insertion depth than the first rack portion K3. Thus, the amount of sliding movement of slider 5 in the direction of arrow b in FIG. 36 is larger when the second rack portion K4 is inserted than when the first rack portion K3 is inserted. As a result, the second presser portion 5*e* of slider 5 and the end 142*b* of lock spring 142 that did not contact each other when the first rack portion K3 was inserted, now contact each other.

When the second presser portion 5*e* pushes the end 142*b* of lock spring 142, as shown in FIG. 36, the bulge 142*a* of lock spring 142 pivots to retract from the lock pin insertion hole 140*b*. This cancels the engagement between the engaging groove 130*a* of lock pin 130 and the bulge 142*a* of lock spring 142.

As a result, the lock pin 130 inserted in the lock pin insertion hole 140*a* is pushed out under the biasing force of coil spring 47*a*.

Thus, LED lamp 20, piezoelectric buzzer 21, switching circuit 25, generating circuit 26, counter 27, latch circuit 28 and buzzer/LED driver 29 mounted in the box 2 act as alarm device A. These combined with battery V, power supply switch 6 and wire unit input circuit 24" act as alarm output device B for detecting whether the box and wire unit 130 are interconnected, and outputting an alarm in time of disconnection.

The pinion gear 43 and slider 5 act as lock cancellation device U for canceling the engagement between the engaging grooves 130*a* of lock pins 130 and lock springs 141, 142. The coil springs 47*a,* 47*b* act as pushout device W for pushing out the lock pins 130 in the direction opposite to the direction of insertion.

(9) In the above embodiment, an alarm is outputted by lighting LED lamp 20 and sounding piezoelectric buzzer 21. However, the box 2 may have a transmitting device for transmitting an electric wave, with a device placed in a selected location for receiving the electric wave from the transmitting device and giving an alarm. In this case, an alarm information is outputted by transmitting the electric wave from the transmitting device upon detection of a disconnection of the box 2 and lock pins 130.

(10) In the above embodiment, the wire unit 103 is electrified, and a disconnection of box 2 and wire unit 103 is detected based on de-electrification thereof. However, the wire unit 103 may be formed of optical fiber, and the disconnection may be connected based on whether light emitted from the box 2 returns to the box 2 by way of the wire unit 103.

(11) In the above embodiment, the wire unit 103 is used as mounting device. However, an approximately C-shaped steel wire having engageable portions at opposite ends similar to the engaging grooves 130*a* of lock pins 130 may be used as mounting device.

(12) In the above embodiment, the lock pins 130 at the opposite ends of wire unit 103 are detached from the box 2 independently of each other. The lock pins 130 at the opposite ends may be detached simultaneously from the box 2. In the above embodiment, for example, when the lock pins 130 at the opposite ends are inserted in the box 2, the second rack portion K4 of lock release key K' may be inserted in the key insertion bore 41 to achieve the above simultaneous detachment.

(13) In the above embodiment, the coil springs 47*a*, 47*b* act as the pushout device W for pushing out the lock pins 130. Helical springs or the like may be used instead.

The slider 5 may include push rods for pushing the forward ends of lock pins 130, whereby the lock pins 130 are pushed out with a sliding movement of the slider 5.

We claim:

1. A theft preventive apparatus comprising a box (2) attachable to an object of theft prevention and including detecting means (P) for detecting a preliminary stealing act, and alarm output means (Q) for outputting alarm information based on detection information from the detecting means (P), said box (2) housing light emitting means (20) for emitting light based on the detection information from the detecting means (P) outwardly of said box (2), said box (2) including a light window (34) disposed on a corner thereof for releasing the light from the light emitting means (20).

2. A theft preventive apparatus as defined in claim 1, wherein said light window (34) includes light distributing means (Y) for distributing the light from one said light emitting means (20) in directions of side surfaces of said box (2) adjacent said light window (34).

3. A theft preventive apparatus as defined in claim 2, wherein said light distributing means (Y) comprises slant surfaces (34*a*, 34*b*) formed in said light window (34) for distributing the light in the directions of side surfaces (2*d*, 2*e*) of said box (2) adjacent said light window (34).

4. A theft preventive apparatus as defined in claim 1, wherein said detecting means (P) includes receiver means (22) mounted in said box (2) for receiving a signal from a transmitter (O) installed in a particular location, and said alarm output means (Q) includes alarm sound output means (21) for outputting an alarm sound based on detection information from said receiver means (22).

5. A theft preventive apparatus as defined in claim 4, wherein said alarm sound output means (21) is constructed so as to not transmit via the same medium as the signal from said transmitter (O).

6. A theft preventive apparatus as defined in claim 5, wherein said alarm sound output means (21) comprises a piezoelectric buzzer.

7. A theft preventive apparatus as defined in claim 6, wherein said box (2) houses a battery (V) for supplying power to said alarm sound output means (21) and said alarm sound output means (21) opposed to each other, and a flat terminal unit (33) having a terminal connected to a terminal of said battery (V) and a terminal connected to an electrode of said alarm sound output means (21) is disposed between said battery (V) and said alarm sound output means (21).

8. A theft preventive apparatus as defined in claim 5, wherein said alarm sound output means (21) is operable to output an intermittent sound as the alarm sound.

9. A theft preventive apparatus as defined in claim 5, wherein said box (2) has sound release openings (10) formed in a side surface thereof for releasing the alarm sound outputted from said alarm sound output means (21) outside said box (2).

10. A theft preventive apparatus as defined in claim 9, wherein said box (2) has a shield wall (32*b*) mounted therein for shielding components in the box (2) against exposure through said openings (10).

11. A theft preventive apparatus as defined in claim 5, wherein said receiver means (22) comprises a resonance antenna for operating said alarm output means (O) upon receipt of said signal from said transmitter (O), and having a coil (L), a capacitor (C) and a resistor (R) in parallel connection.

12. A theft preventive apparatus as defined in claim 11, wherein said transmitter (O) is in form of a pair of panels, said resonance antenna (22) has reception sensitivity adjustable in advance according to an expected spacing between the pair of said panels.

13. A theft preventive apparatus as defined in claim 1, wherein said detecting means (P) includes a mounting member for attaching said box (2) to said object of theft prevention, a detecting switch operable with insertion and removal of said mounting member, and receiver means (22) mounted in said box (2) for receiving a medium of information communication transmitted from a transmitter (O) installed in a particular location.

14. A theft preventive apparatus as defined in claim 13, wherein said mounting member comprises a mounting pin including a shank (13A) and a head (13B) supporting one end thereof, said box (2) is attachable to said object of theft prevention by piercing said shank (13A) through said object of theft prevention and connecting it to said box (2).

15. A theft preventive apparatus as defined in claim 13, wherein said mounting member includes continuous connectors (130) attached to opposite ends thereof for insertion into and removal from said box (2), a wire (131) interconnecting said connectors (130), and a sheath (132) for covering parts of the wire (131) and said connectors (130).

16. A theft preventive apparatus as defined in claim 13, wherein said receiver means (22) comprises a resonance antenna for operating said alarm output means (Q) upon receipt of said signal from said transmitter (O), and having a coil (L), a capacitor (C) and a resistor (R) in parallel connection.

17. A theft preventive apparatus as defined in claim 16, wherein said transmitter (O) is in form of a pair of panels, said resonance antenna (22) has reception sensitivity adjustable in advance according to an expected spacing between the pair of said panels.

* * * * *